US005460360A

United States Patent [19]

Kotani et al.

[11] Patent Number: 5,460,360

[45] Date of Patent: Oct. 24, 1995

[54] DOCUMENT CONVEYING APPARATUS FOR CONVEYING DOCUMENTS OF DIFFERENT LENGTH IN AN IMAGE PROCESSING MACHINE

[75] Inventors: Takashi Kotani; Yasushi Kamezaki; Hiroyuki Nagai; Yukio Tanisaki; Hiromichi Oguma, all of Osaka, Japan

[73] Assignee: Mita Industrial Co., Ltd., Osaka, Japan

[21] Appl. No.: 158,225

[22] Filed: Nov. 29, 1993

[30] Foreign Application Priority Data

Nov. 30, 1992 [JP] Japan ..... 4-319521

[51] Int. Cl.[6] ..... B65H 5/22

[52] U.S. Cl. ..... 271/3.13; 271/147; 271/303

[58] Field of Search ..... 271/3.1, 147, 303, 271/207

[56] References Cited

U.S. PATENT DOCUMENTS

| | | | |
|---|---|---|---|
| 5,096,177 | 3/1992 | Saeki et al. | 271/3.1 |
| 5,186,446 | 2/1993 | Saeki et al. | 271/3.1 |
| 5,192,976 | 3/1993 | Kitajima et al. | 271/3.1 X |
| 5,351,112 | 9/1994 | Maijo et al. | 271/3.1 X |

FOREIGN PATENT DOCUMENTS

| | | | |
|---|---|---|---|
| 60-193336 | 12/1985 | Japan . | |
| 63-143125 | 6/1988 | Japan . | |
| 180667 | 7/1988 | Japan | 271/3.1 |
| 63-202556 | 8/1988 | Japan . | |
| 391768 | 4/1991 | Japan . | |

*Primary Examiner*—David H. Bollinger
*Attorney, Agent, or Firm*—Antonelli, Terry, Stout & Kraus

[57] ABSTRACT

A document conveying apparatus of the circulation type has a first document discharge port disposed above the surface of the document-placing plate on the upstream side thereof and a second document discharge port disposed above the surface of the document-placing plate but below the first document discharge port on the downstream side of the first document discharge port. A first document transfer mechanism and a second document transfer mechanism are disposed in relation to the first document discharge port and the second document discharge port, respectively. On a downstream region of the second document discharge port is disposed a turn plate which is selectively pivoted between an ascended position and a descended position.

11 Claims, 11 Drawing Sheets

DOCUMENT CONVEYING APPARATUS FOR CONVEYING DOCUMENTS OF DIFFERENT LENGTH IN AN IMAGE PROCESSING MACHINE

FIELD OF THE INVENTION

The present invention relates to a document conveying apparatus of a type in which a document placed on a document-placing plate means is introduced into a document conveying passage that extends along a transparent plate in a document processor, passing through a document introduction passage, and is delivered back onto the document-placing plate means from the document conveying passage passing through a document delivery passage. Particularly, the invention relates to a document conveying apparatus of a type in which a document delivered onto a document-placing plate means is introduced again into the document conveying passage passing through the document introduction passage.

DESCRIPTION OF THE PRIOR ART

A document conveying apparatus of the so-called circulation type has heretofore been adapted to a document processor such as an electrostatic copying machine, an image reader or the like and has been put into practical use. Such a document conveying apparatus comprises a document-placing plate means positioned above a transparent plate of a document processor, a document introduction passage disposed between the document-placing plate means and a document conveying passage that extends along the surface of the transparent plate, a document delivery passage disposed between the document conveying passage and the document-placing plate means, a document introduction means which successively introduces a plurality of documents placed in a stack on the document-placing plate means into the document conveying passage through the document introduction passage, starting with the document at the lowermost position, a document conveying means for conveying the documents through the document conveying passage, and a document delivery means which delivers the documents conveyed from the document conveying passage onto the document-placing plate means through the document delivery passage. The plurality of documents that are to be copied or read out are stacked at a predetermined position on the document-placing plate means. Among the documents stacked, the document at the lowermost position is first introduced into the document conveying passage, passed through the document introduction passage and placed at a predetermined position in the document conveying passage. After a predetermined processing such as exposure of the document image to light or image reading, the document is delivered from the document conveying passage back onto the document-placing plate through the document delivery passage. The document delivered from the document delivery passage is delivered onto the uppermost document on the document-placing plate. As the documents of the lower positions are successively conveyed, the document placed on the uppermost one then goes downwards and finally arrives at the lowermost position in the stack, and may again be introduced into the document conveying passage through the document introduction passage.

In the document conveying apparatus of the above-mentioned type, it is important that the document delivered from the document delivery passage onto the document-placing plate means is placed at the uppermost position of documents without being mixed into the documents that are already stacked on the document-placing plate means. If a document delivered from the document delivery passage is mixed into the stack of documents on the document-placing plate means, the order of the documents in the stack changes. Further, in order to introduce again the document delivered onto the document-placing plate means through the document introduction passage, it is important that the document delivered onto the document-placing plate means is positioned sufficiently reliably at a predetermined position on the document-placing plate means. When only documents of a predetermined length are treated without changing their length in the conveying direction, the above-mentioned requirement can be satisfied relatively easily by suitably setting the position of the document discharge port provided at the downstream end of the document delivery passage in the up-and-down direction and in the conveying direction with respect to the surface of the document-placing plate means. In practice, however, there exist documents of a variety of sizes, and in most cases it is desired to handle documents of various sizes. In such a case, it is not necessarily easy to satisfy the aforementioned requirements.

According to the document conveying apparatuses disclosed in Japanese Laid-Open Patent Publications Nos. 143125/1988, 202556/1988 and 91768/1991, the downstream end of the document delivery passage is disposed in a manner such that it can be extended or retracted in the direction in which the surface of the document-placing plate means extends, i.e., the document discharge port at the downstream end of the document delivery passage is disposed in a manner such that it can be moved in the direction in which the surface of the document-placing plate means extends, and the document discharge port is moved along the surface of the document-placing plate means either automatically or by hand to accord with the length of the document in the direction in which it is conveyed, in order to satisfy the aforementioned requirements.

According to a document conveying device disclosed in Japanese Laid-Open Utility Model Publication No. 193336/1985, the downstream portion of the document delivery passage is upwardly extended beyond the upstream portion of the document-placing plate means, a plurality of document discharge ports are formed spaced well apart in the direction of conveyance in the downstream portion of the document conveying passage, and document transfer control means are disposed, being related to each of the document discharge ports except the document discharge port of the most downstream side. The documents that are delivered onto the document-placing plate means through the document delivery passage are discharged through a document discharge port that is selected in accordance with the length of the document in the direction of conveyance thereof.

However,in the document conveying apparatus of a type in which the document discharge port is movably disposed, the user must move by hand the document discharge port to accord with a change in the length of the document in the direction of conveyance thereof, which requires cumbersome operation to move the document discharge port by hand. When the document discharge port is to be automatically moved, the document conveying apparatus must be equipped with a considerably complex and expensive constitution. When the document discharge port is to be automatically moved, in particular, the moving mechanism exposed outside the document conveying apparatus must be equipped with a safety measure.

In the document conveying apparatus of a type in which a plurality of document discharge ports are disposed in the downstream portion of the document delivery passage that upwardly extends beyond the upstream portion of the document-placing plate means, on the other hand, the constituent elements related to the downstream portion of the document delivery passage must be moved from the document-placing plate means such that the downstream portion of the document-placing plate means is exposed when a document which is relatively long in the direction of conveyance is placed on the document-placing plate means. When the document is particularly long in the direction of conveyance thereof, therefore, the user must make a cumbersome operation.

SUMMARY OF THE INVENTION

A principal object of the present invention is to provide a novel and improved document conveying apparatus which is capable of satisfying the aforementioned requirements for copying documents of a variety of sizes without requiring cumbersome operation and without the need of a complex and expensive constitution.

Another object of the present invention is to provide a novel and improved document conveying apparatus which is capable of satisfying the aforementioned requirements for copying documents of a variety of sizes without causing the apparatus to be of a large size and in particular, without causing the size of the apparatus to become too great in the up- and down-direction.

A further object of the present invention is to provide a novel and improved document conveying apparatus which is capable of reliably preventing the documents delivered from the document delivery passage onto the document-placing plate means from being mixed into the stack of documents on the document-placing plate means. The above technical problem remains not only in the document conveying apparatus of the circulation type in which a document delivered onto the document-placing plate means is introduced again into the document conveying passage via the document introduction passage but also in the document conveying apparatus of a type in which the document is simply delivered from the document delivery passage onto the document-placing plate means (i.e., of a type in which the document-placing plate means is simply used as a plate for receiving the delivered documents).

According to one aspect of the present invention, a document delivery passage includes a first document discharge port disposed on the upstream side of the document-placing plate means, a second document discharge port disposed on the downstream side of the first document discharge port, a first branched delivery passage leading to said first document discharge port, and a second branched delivery passage leading to said second document discharge port, and the document delivery passage is so constructed that a document which is relatively long in the direction of conveyance thereof is delivered onto the document-placing plate means via the first branched delivery passage and the first document discharge port, and a document which is relatively short in the direction of conveyance thereof is delivered onto the document-placing plate means via the second branched delivery passage and the second document discharge port. Furthermore, provision is made of a first document transfer mechanism which transfers the documents discharged from the first document discharge port onto the document-placing plate means in toward the downstream direction on the surface of the document-placing plate means, and a second document transfer mechanism which transfers the documents discharged from the second document discharge port onto the document-placing plate means in the downstream direction on the surface of the document-placing plate means.

According to another aspect of the present invention, the first document discharge port in the document delivery passage is disposed above the surface of the document-placing plate means, and the second document discharge port in the document delivery passage is disposed above the surface of the document-placing plate means but below the first document discharge port. It is desired that the surface of the document-placing plate means be tilted upward in the downstream direction from the second document discharge port for a predetermined distance in the downstream direction.

According to a further aspect of the present invention, the document-placing plate means is defined by a turn plate that is pivotably mounted on the downstream end thereof and extends from the second document discharge port for a predetermined distance in the downstream direction. When a document which is relatively long in the direction of conveyance is delivered onto the document-placing plate means via the first branched delivery passage and the first document discharge port, the turn plate is located at an ascended position where its upstream end is located above the second document discharge port and when a document which is relatively short in the direction of conveyance is delivered onto the document-placing plate means via the second branched delivery passage and the second document discharge port, the turn plate is located at a descended position where its upstream end is located below the second document discharge port. When brought to the ascended position, the turn plate should be tilted downward in the downstream direction and when brought to the descended position, the turn plate should be tilted upward in the downstream direction.

According to a still further aspect of the present invention, there are provided front-end-of-document restriction members which freely move between a descended position at which they are in contact with the surface of the document-placing plate means or the surface of the document placed thereon and an ascended position which is upwardly spaced from the surface of the document-placing plate means, and further freely move in the back-and-forth direction along the surface of the document-placing plate means. It is preferred that the front-end-of-document restriction members are provided with an electromagnetic solenoid and are resiliently urged toward the descended position when the electromagnetic solenoid is de-energized and are brought to the ascended position when the electromagnetic solenoid is energized.

According to a yet further aspect of the present invention, a first document transfer mechanism disposed in relation to the first document discharge port is allowed to reciprocatingly move between a retracted position located on the upstream side of the first document discharge port and a most advanced position which is toward the downstream side by a predetermined distance from the retracted position, and includes a protruding member that upwardly protrudes above the surface of the document-placing plate means. A second document transfer mechanism disposed in relation to the second document discharge port is allowed to reciprocatingly move between a retracted position located on the upstream side of the second document discharge port and a most advanced position which is toward the downstream side by a predetermined distance from the retracted position, and includes a protruding member that upwardly protrudes above the surface of the document-placing plate means. It is preferred that the protruding member of the first document transfer mechanism and the protruding member of the second document transfer mechanism, respectively, have an upwardly tilted upper surface extending in the downstream direction with a relatively moderate angle of inclination.

Even in the document conveying apparatus of the type in which the document is simply delivered from the document delivery passage onto the document-placing plate means ( i.e., of the type in which the document-placing plate means is simply used as a plate for receiving the delivered documents), the document-placing plate means is provided with a protruding member which upwardly protrudes above the surface thereof, and the document introduced into the document conveying passage through the document introduction passage is placed on the document-placing plate means on the downstream side of the protruding member, so that the front end of the document delivered from the document conveying passage through the document delivery passage gets over the protruding member and advances onto a document that is located on the downstream side of the protruding member. Even in this case, it is preferred that the protruding member has an upwardly tilted upper surface extending in the downstream direction with a relatively moderate angle of inclination.

In the document conveying apparatus constituted according to the present invention, a document which is relatively long in the direction of conveyance is delivered onto the document-placing plate means through the first branched delivery passage and the first document discharge port. When the document is then introduced again into the document conveying passage through the document introduction passage, it is transferred up to a predetermined position on the document-placing plate means by the action of the first document transfer mechanism. A document which is relatively short in the direction of conveyance is delivered onto the document-placing plate means through the second branched delivery passage and the second document discharge port in the document delivery passage. When the document is then to be introduced again into the document conveying passage through the document introduction passage, it is transferred up to a predetermined position on the document-placing plate means by the action of the second document transfer mechanism. When the document which is relatively long in the direction of conveyance is placed on the document-placing plate means, even those portions in front of and at the back of the second document discharge port on the downstream side of the first document discharge port can be utilized as the document-placing zone without requiring any particular manual operation.

Since the first document discharge port is disposed above the second document discharge port on the downstream side of the second document discharge port, the document discharged from the second document discharge port is prevented from being hampered by the first document discharge port or the constitution related thereto, and the document discharged from the first document discharge port is prevented from being hampered by the second document discharge port or the constitution related thereto. The document-placing plate means whose surface is tilted upward in the downstream direction from the second document discharge port for a predetermined distance in the downstream direction helps suppress an increase in the size of the apparatus in the up- and down-directions due to provision of the first document discharge port and the second document discharge port. Furthermore, the document-placing plate means is defined by a turn plate which is pivotably mounted on its downstream-side end thereof from the second document discharge port for a predetermined distance in the downstream direction. Therefore, when the document which is relatively long in the direction of conveyance is delivered onto the document-placing plate means through the first branched delivery passage and the first document discharge port, the turn plate is brought to its ascended position where the upstream end thereof is located above the second document discharge port. When the document which is relatively short in the direction of conveyance is delivered onto the document-placing plate means through the second branched delivery passage and the second document discharge port, on the other hand, the turn plate is brought to its descended position where the upstream end thereof is located below the second document discharge port, so that even those portions in front of and at the back of the second document discharge port are utilized as the document-placing zone. Thus, even when a document which is relatively long in the direction of conveyance is placed on the document-placing plate means, there arouses no inconvenience in the state of placing a document around the second document discharge port. Moreover, the document that is placed around the second document discharge port can be detected by a suitable detector such as a reflection-type optical detector or the like.

When the documents are stacked on the document-placing plate means, the front-end-of-document restriction members are brought to a predetermined position at the upstream end of the document-placing plate means and, at the same time, to the descended position where it comes in contact with the surface of the document-placing plate means. Thus, the documents can be placed very easily at a predetermined position on the document-placing plate means with the front end of the stacked documents being in contact with the front-end-of-document restriction members. When the documents are to be successively introduced into the document conveying passage through the document introduction passage, the front-end-of-document restriction members are raised to the ascended position so as not to hamper the introduction of the documents. After being raised to the ascended position, the front-end-of-document restriction members are moved in upstream direction up to a required position corresponding to the length of the document in the direction of conveyance and are then lowered to the descended position where they come in contact with the surface of the document-placing plate means or with the surface of the document placed thereon. The documents successively delivered onto the document-placing plate means from the document delivery passage are brought at their front ends into contact with the front-end-of-document restriction members and are successively stacked at a predetermined position on the document-placing plate means.

On the document-placing plate means is disposed a protruding member which upwardly protrudes beyond the surface thereof. The stacked documents are placed on the document-placing plate means on the downstream side of the protruding member, and the surface of the document at the uppermost position is located under the below end of the protruding member. The document delivered from the document delivery passage goes over the protruding member and is forwarded on the document-placing plate means. Therefore, the document delivered from the document delivery passage is reliably prevented from being mixed into the stack of documents that are placed on the document-placing plate means on the downstream side of the protruding member. When suitably moved in the direction of conveyance, the protruding member also works as a document transfer mechanism that moves forward the document that is delivered from the document delivery passage.

DETAILED DESCRIPTION OF THE PREFERRED EMBODIMENTS

Figure 1:
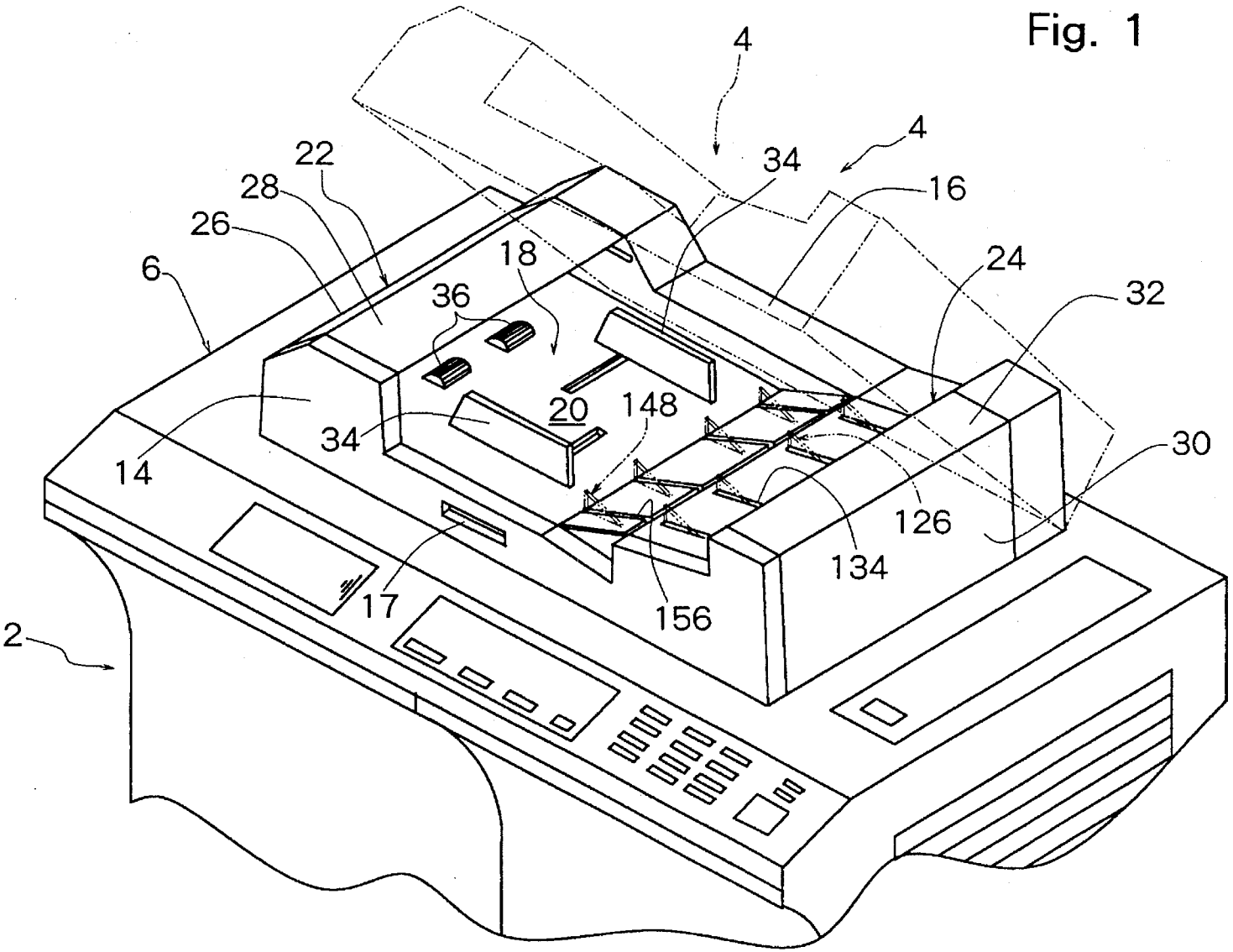
FIG. 1 is a perspective view illustrating an electrostatic copying machine equipped with a document conveying apparatus that is constituted according to a preferred embodiment of the present invention.
Figure 2:
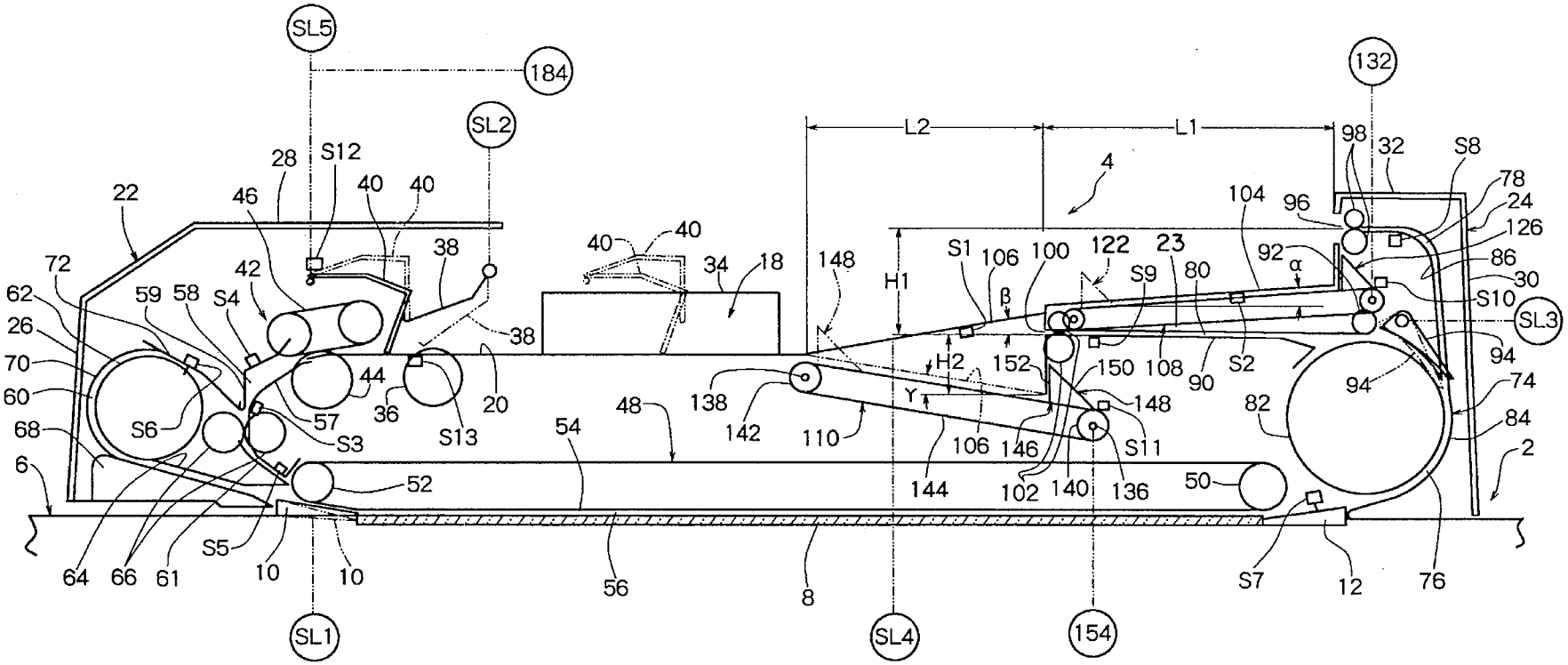
FIG. 2 is a sectional view of the document conveying apparatus shown in FIG. 1.

A preferred embodiment of the document conveying apparatus of the circulation type constituted according to the present invention will now be described in detail in conjunction with the accompanying drawings. Outline of the whole constitution:

FIGS. 1 and 2 illustrate an upper end portion of an electrostatic copying machine 2 and a document conveying apparatus 4 mounted thereon. The electrostatic copying machine 2 has a housing 6, and a transparent plate 8 (FIG. 2), which may be a glass, plate is disposed on the upper surface of the housing 6. On one side of the transparent plate 8 (left side in FIG. 2) is disposed a document restriction member 10, and on the other side thereof (right side in FIG. 2) is disposed a stationary mounting member 12. The document restriction member 10 is mounted to freely pivot between an acting position indicated by a solid line in FIG. 2 and a descended position indicated by a two-dotted chain line in FIG. 2. When the document restriction member 10 is located at the acting position, the end thereof (right edge in FIG. 2) is upwardly protruded slightly beyond the upper surface of the transparent plate 8. When the document restriction member 10 is lowered to the descended position, the end thereof is descended to be lower than the upper surface of the transparent plate 8. The document restriction member 10 is provided with an electromagnetic solenoid SL1 and is brought to the acting position when the electromagnetic solenoid SL1 is de-energized, and is brought to the descended position when the electromagnetic solenoid SL1 is energized. The document conveying apparatus 4 constituted according to the present invention is mounted on the upper surface of the housing 6 of the electrostatic copying machine 2 to freely pivot, between a closed position indicated by a solid line in FIG. 1 and an open position indicated by a two-dotted chain line (in FIG. 1) on the rotation axis which extends along the rear edge of the transparent plate 8. In case a document is to be placed by hand on the transparent plate 8 of the electrostatic copying machine 2, the document conveying apparatus 4 is brought to the open position so that the transparent plate 8 is exposed. The document is then placed at a predetermined position on the transparent plate 8, and the document conveying apparatus 4 is brought to the closed position to cover the transparent plate 8 and the document that is placed thereon. In placing the document on the transparent plate 8, an edge of the document is brought into contact with the front edge of the document restriction member 10 that is located at the acting position, so that the document is placed at the predetermined position. In case the document is to be automatically introduced onto the transparent plate 8 and then delivered from the transparent plate 8, the document conveying apparatus 4 is located at the closed position.

With reference to FIG. 1, the illustrated document conveying apparatus 4 includes a front-side cover 14 and a rear-side cover 16 that are disposed at a distance in the back-and-forth direction (direction perpendicular to the surface of the paper in FIG. 2). In the front surface of the front-side cover 14 is formed a recessed portion 17 in which fingers can be inserted for opening or closing the document conveying apparatus 4. The front-side cover 14 and the rear-side cover 16 can be made of a suitable synthetic resin. Inside the rear-side cover 16 is disposed a rear support board (not shown) which is pivotably mounted on the upper surface of the housing 6 of the electrostatic copying machine 2 via a mounting mechanism (not shown) which may be of a known structure. A variety of constituent elements of the document conveying apparatus 4 are directly or indirectly supported by the rear support board. A document-placing plate means 18 is disposed between the front-side cover 14 and the rear-side cover 16. The downstream half portion of the document-placing plate means 18 (left half portion in FIG. 2) is defined by a stationary plate 20 of a synthetic resin that extends substantially horizontally. Constitution of the upstream half portion of the document-placing plate means 18 will be referred to later. A left end cover 22 is disposed between the left ends of the front-side cover 14 and the rear-side cover 16, and a right end cover 24 is disposed between their right ends. The left end cover 22 has an upper wall 28 which extends over the downstream portion of the document-placing plate means 18, together with a left end wall 26 which covers the left end surface of the document conveying apparatus 4. The right end cover 24 has a right end wall 30 which covers the right end surface of the document conveying apparatus 4 and a top wall 32 which extends toward the left from the upper end of the right end wall 30.

With reference to FIGS. 1 and 2, the stationary plate 20 of the document-placing plate means 18 is provided with a pair of width restriction members 34 that are movable in the direction of width. Such width restriction members 34 are coupled to each other via a well-known rack-and-pinion mechanism (not shown) under the stationary plate 20, and are caused to move, with synchlonized movement, in a direction to approach each other and in a direction to separate away from each other. As desired, known width-unifying pieces (not shown) which are movable in the direction of width are arranged on the inside of the pair of width restriction members 34 in the direction of width. After the document delivered onto the document-placing plate means 18 is introduced into between the pair of width restriction members 34, the width-unifying pieces are moved in the direction of width by a suitable operation means such as an electromagnetic solenoid (not shown) in order to make very precisely uniform the positions of the documents in the direction of width as will be described later. A pair of openings which are in alignment in the direction of width are formed in the stationary plate 20 on the downstream side of the pair of width restriction members 34, and a pair of feed rollers 36 which are rotatably disposed are permitted to upwardly protrude through the openings. As shown in FIG. 2, a pushing member 38 is mounted in relation to the feed rollers 36 above the stationary plate 20. The pushing member 38 is provided with an electromagnetic solenoid SL2, and when the electromagnetic solenoid SL2 is de-energized, it is located at an ascended position which is shown in FIG. 2, but when the electromagnetic solenoid. SL2 is energized, it is resiliently urged in the counterclockwise direction in FIG. 2 thereby to push the document placed on the stationary plate 20 to the feed rollers 36. A pair of front-end-of-document restriction members 40 (which will be described later in further detail) are arranged above the stationary plate 20. A document separation means 42 is disposed on the downstream side of the feed rollers 36. The document separation means 42 is constituted by a separation roller 44 which upwardly protrudes through a notch formed in the stationary plate 20 and a separation belt mechanism 46 which is disposed above the separation roller 44, being opposed thereto. The separation roller 44 is rotated in the counterclockwise direction in FIG. 2, and the separation belt mechanism 46 is rotated in the counterclockwise direction too in FIG. 2 via a one-way rotary clutch (not shown). The document separation means prevents the feeding of two or more documents from the stack of documents placed on the document-placing plate means 18 and permits the conveyance from a document of the lowermost position only.

With reference to FIG. 2, a conveyer belt mechanism 48 is disposed under the document-placing plate means 18. The conveyer belt mechanism 48 which constitutes a conveyer means includes a driven roller 50 and a follower roller 52 which are arranged at a distance in the direction of conveyance (right-and-left direction in FIG. 2), as well as an endless belt 54 wrapped around them. The lower running portion of the endless belt 54 extends along the transparent plate 8 of the electrostatic copying machine 2, and a document conveying passage 56 is defined between them. A document introduction passage 58 is formed between the document conveying passage 56 and the document-placing plate means 18. The document introduction passage 58 is defined between an inside guide plate 57 and outside guide plates 59 and 61. A pair of introduction rollers 66 are disposed in the document introduction passage 58. The pair of introduction rollers 66 together with the feed rollers 36 and the document separation means 42 constitute a document introduction means which introduces the document on the document-placing plate means 18 to the document conveying passage 56 through the document introduction passage 58. In the illustrated embodiment, a document inverting passage 60 is disposed on the left side of the document introduction passage 58 to invert the front side of the document introduced onto the document conveying passage 56 to the backside . The document inverting passage 60 is defined between an inverting roller 62 which is rotated in the clockwise direction in FIG. 2, the inside guide plate 64 and the outside guide plates 68, 70, 72.

A document delivery passage 74 is disposed on the right side of the document conveying passage 56. The document delivery passage 74 includes a common upstream portion 76, and a first branched delivery passage 78 and a second branched delivery passage 80 which extend, being branched into two, from the common upstream portion 76. The common upstream portion 76 is defined between a delivery roller 82 that is rotated in the counterclockwise direction in FIG. 2 and an upstream portion of the outside guide plate 84. The first branched delivery passage 78 is defined between an inside guide plate 86 and a downstream portion of the outside guide plate 84. The second branched delivery passage 80 is defined between the delivery roller 82, an inside guide plate 90 and a driven roller 92, an outside guide plate 93. A delivery control plate 94 is disposed at a branch point of the first branched delivery passage 78 and the second branched delivery passage 80. The delivery control plate 94 is provided with an electromagnetic solenoid SL3, and when the electromagnetic solenoid SL3 is de-energized it is located at short-document delivery position indicated by a solid line in FIG. 2 and when the electromagnetic solenoid SL3 is energized it is moved to a long document delivery position indicated by a two-dotted chain line in FIG. 2. When the delivery control plate 94 is located at the short-document delivery position, the document that moves through the document delivery passage 74 is permitted to enter into the second branched delivery passage 80 from the common upstream portion 76, and is delivered onto the document-placing plate means 18 from the second branched delivery passage 80. When the delivery control plate 94 is located at the long-document delivery position, the document that moves through the document delivery passage 74 is permitted to enter into the first branched delivery passage 78 from the common upstream portion 76, and is delivered onto the document-placing plate means 18 from the first branched delivery passage 78. A first document discharge port 96 is formed at the downstream end of the first document delivery passage 78, and a first pair of document discharge rollers 98 are disposed just on the upstream side of the first document discharge port 96. Similarly, a second document discharge port 100 is formed at the downstream end of the second document delivery passage 80, and a second pair of document discharge rollers 102 are disposed just on the upstream side of the second document discharge port 100. Arrangement of the first and second document discharge ports:

With reference to FIGS. 1 and 2, what is important in the document conveying apparatus 4 constituted according to the present invention is that the second document discharge port 100 is disposed on the downstream side (left side in FIG. 2) of the first document discharge port 96 by a predetermined distance. Moreover, the first document discharge port 96 is disposed above the surface of the document-placing plate means 18, and the second document discharge port 100 is disposed above the surface of the document-placing plate means 18 but below the first document discharge port 96. Thus, between the first document discharge port 96 and the second document discharge port 100, there exist a distance L1 in the document-conveying direction and a distance H1 in the vertical direction. When dealing with the documents having, for instance, a minimum length of 182 mm in the direction of conveyance (JIS Standards, B5 that is transversely arranged) and a maximum length of 17 inches (about 432 mm), the above distance L1 needs to be about 150 mm and the distance H1 needs to be about 60 mm. In a region of from the first document discharge port 96 to the second document discharge port 100, the document-placing plate means 18 is defined by a main portion of a stationary plate 104 that extends in the direction of conveyance. The surface of main portion of the stationary plate 104 may be extended substantially horizontally, but it is preferred that it be extended slightly tilted downwards by an angle α which may be about 10 degrees toward the downstream. Document-placing plate means on the downstream side of the second document discharge port:

With reference to FIGS. 1 and 2, the document-placing plate means 18 is defined by a turn plate 106 in a region of from the second document discharge port 100 up to a predetermined length L2 toward the downstream direction. The length L2 needs to be about 150 mm. The turn plate 106 is mounted to be freely turned between an ascended position indicated by a solid line in FIGS. 1 and 2 and a descended position indicated by a two-dotted chain line in FIG. 2 on the downstream end as a center axis. The turn plate 106 is provided with an electromagnetic solenoid SL4, and is located at the ascended position when the electromagnetic solenoid SL4 is de-energized, and is brought to the descended position when the electromagnetic solenoid SL4 is energized. At the ascended position, the upstream end of the turn plate 106 is positioned above the second document discharge port 100, extends downwardly tilted by an angle β which may be about 10 degrees from the upstream end toward the downstream, and smoothly connects the surface of the stationary plate 104 disposed on the upstream side with the surface of the stationary plate 20 that is disposed on the downstream side. Therefore, the whole surfaces of the document-placing plate means 18 defined by the surfaces of the stationary plate 20, turn plate 106 and stationary plate 104 extend smoothly and continuously without abrupt steps. Thus, it is allowed to place a document which is long in the direction of conveyance on the whole surfaces of the document-placing plate means 18. As will be described later, furthermore, even when the turn plate 106 is provided with a reflection-type optical document detector, the document that extends from the surface of the turn plate 106 to the surface of the stationary plate 104 can be very reliably detected by such a detector (when the turn plate 106 is in the descended position, a document which is long in the direction of conveyance extends upwardly being remote above the turn plate 106 and cannot be easily detected). When the turn plate 106 is located at the descended position, its upstream end is positioned under the second document discharge port 100 and extends upwardly tilted by an angle γ which may be about 15 degrees from the upstream end toward the downstream side. By extending the turn plate 106 at the descended position in an upwardly tilted manner toward the downstream side, it is allowed to maintain a predetermined height H2 from the second document discharge port 100 to the surface of the document-placing plate means 18 (i.e., surface of the upstream end of the turn plate 106) just on the downstream side thereof, in order to prevent the total height of the document conveying apparatus 4 from becoming too great. The above-mentioned height H2 may be about 40 mm.

First and second document transfer mechanisms:

In the document conveying apparatus 4 constituted according to the present invention, a first document transfer mechanism 108 and a second document transfer mechanism 110 are disposed in relation to the first document discharge port 96 and the second document discharge port 100, respectively. The first document transfer mechanism 108 is disposed under the first document discharge port 96 and the stationary plate 104 on the downstream side thereof, and the second document transfer mechanism 110 is disposed under the second document discharge port 100 and the turn plate 106 on the downstream side thereof.

Figure 3:
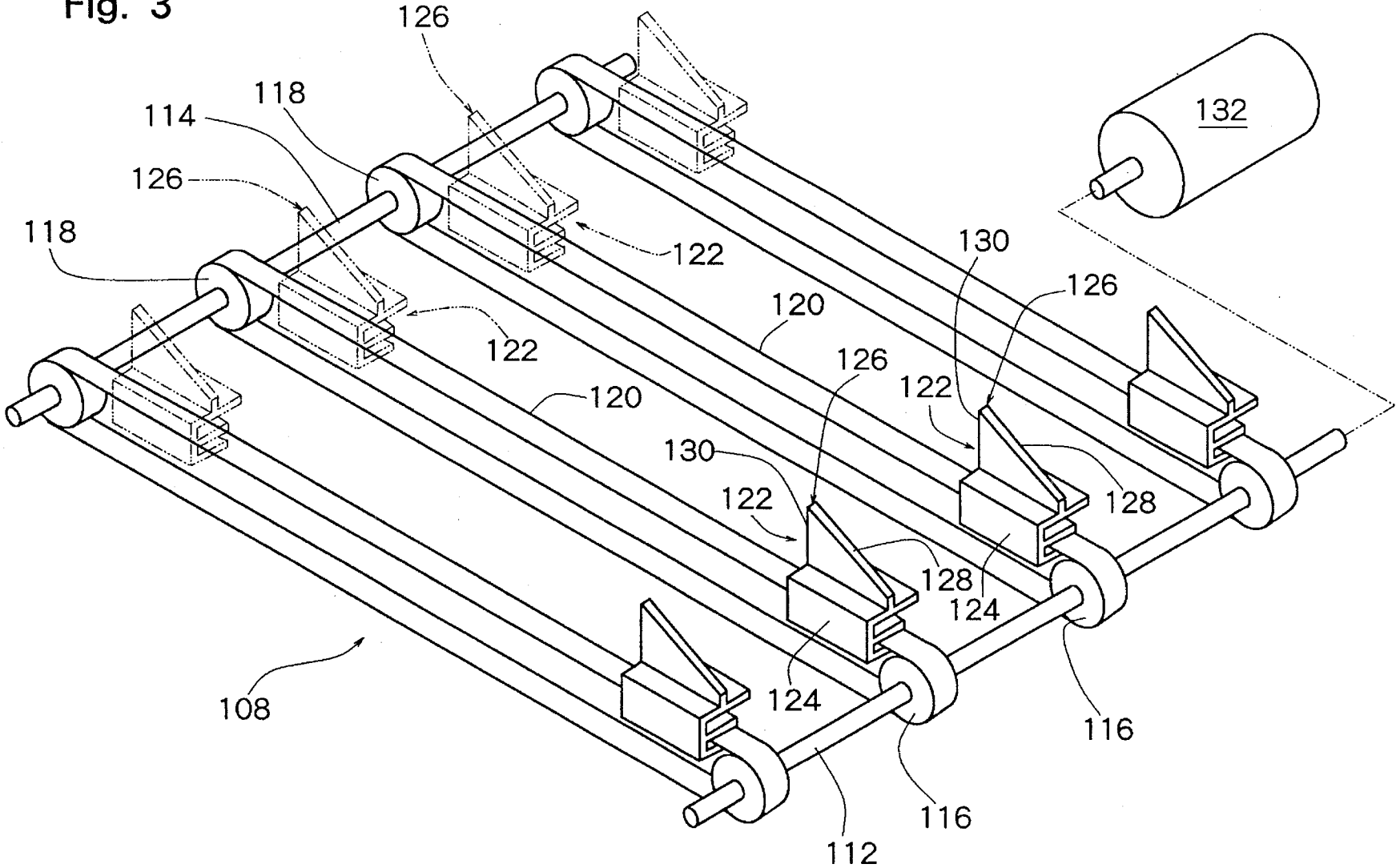
FIG. 3 is a partial perspective view illustrating a first document transfer mechanism in the document conveying apparatus shown in FIG. 1.

With reference to FIG. 3 together with FIGS. 1 and 2, the first document transfer mechanism 108 includes a driven shaft 112 and a follower shaft 114 that are rotatably mounted at a distance in the document conveying direction. Four pulleys 116 are fitted to the driven shaft 112 at a suitable distance in the axial direction thereof, and, similarly, four pulleys 118 are fitted to the follower shaft 114 at a suitable distance in the axial direction thereof. Endless belts 120 are wrapped around pulleys 116 and 118 which are in a relationship of pairs. A protruding member 122 is fitted to the upper running portion of each of the endless belts 120. The protruding member 122 has a base portion 124 fitted to the endless belt 120 and a protruding main portion 126 which upwardly protrudes from the base portion 124. It is desired that the upper surface 128 on the upstream side (upper surface on the left side in FIG. 2) of the protruding main portion 126 of the protruding member 122 be upwardly tilted at a relatively moderate angle which may be, for example, about 45 degrees toward the downstream side. It is desired that a steep surface 130 which is substantially vertical be formed on the downstream side (left side in FIG. 2) of the protruding main portion 126 of the protruding member 122. The driven shaft 112 is drivably coupled to a rotary drive source 132, which may be an electric motor, via a suitable transmission means (not shown), and is suitably rotated in either the normal direction or the reverse direction to drive the endless belt 120. The protruding member 122 is allowed to be reciprocatingly moved between a retracted position indicated by a solid line in FIGS. 2 and 3 and a most advanced position indicated by a two-dotted chain line in FIGS. 2 and 3. As will be understood with reference to FIGS. 1 and 2, four slits 134 are formed in the stationary plate 104, which slits extend in the direction of conveyance and are spaced from each other in the direction of width (direction perpendicular to the surface of the paper in FIG. 2). At the retracted position, the protruding member 122 is located on the upstream side of the first document discharge port. When the protruding member 122 advances from the retracted position toward the downstream direction, the protruding main portion 126 of the protruding member 122 upwardly protrudes through the slit formed in the stationary plate 104 and is advanced in this condition. The protruding main portion 126 of the protruding member 122 acts upon the rear edges of the documents which are stacked being delivered from the first document discharge port 96 and of which the rear edges are positioned on the stationary plate 104, and thus the stack of documents is advanced toward the downstream direction. As will be described later, on the other hand, when the documents which are relatively long in the direction of conveyance are placed on the document-placing plate means 18 in a stacked state and the document at the lowermost position of the stack is discharged onto the document-placing plate means 18, being delivered from the document conveying passage 56 through the document delivery passage 74, the protruding main portion 126 of the protruding member 122 is brought in contact with the rear end, or is positioned close to the rear end, of the documents that are placed in a stacked state, and the discharged document goes over the protruding main portion 126 of the protruding member 122 and is advanced to the upper portion of the stack of documents. The thickness of the stack of documents placed on the document-placing plate means 18 is limited so as to be smaller than the height of the protruding main portion 126 of the protruding member 122, i.e., limited to be smaller than the height of protrusion which protrudes beyond the surface of the stationary plate 104. Therefore, the document that is discharged through the first document discharge port 96 is advanced over the protruding main portion 126 of the protruding member 122, and is placed at the uppermost position of the stack of documents placed on the document-placing plate means, thus being reliably prevented from being mixed into the stack of documents. The above-mentioned functions and effects exhibited by the protruding main portion 126 of the protruding member 122 are produced not only on the document conveying apparatus of the circulation type in which the document delivered onto the document-placing plate means 18 is introduced again into the document conveying passage 56 through the document introduction passage 58, but also on the document conveying apparatus of the type in which the document delivered onto the document-placing plate means 18 is not introduced again into the document conveying passage 56 through the document introduction passage 58 and the document-placing plate means 18 is simply used as a document-receiving plate.

Figure 4:
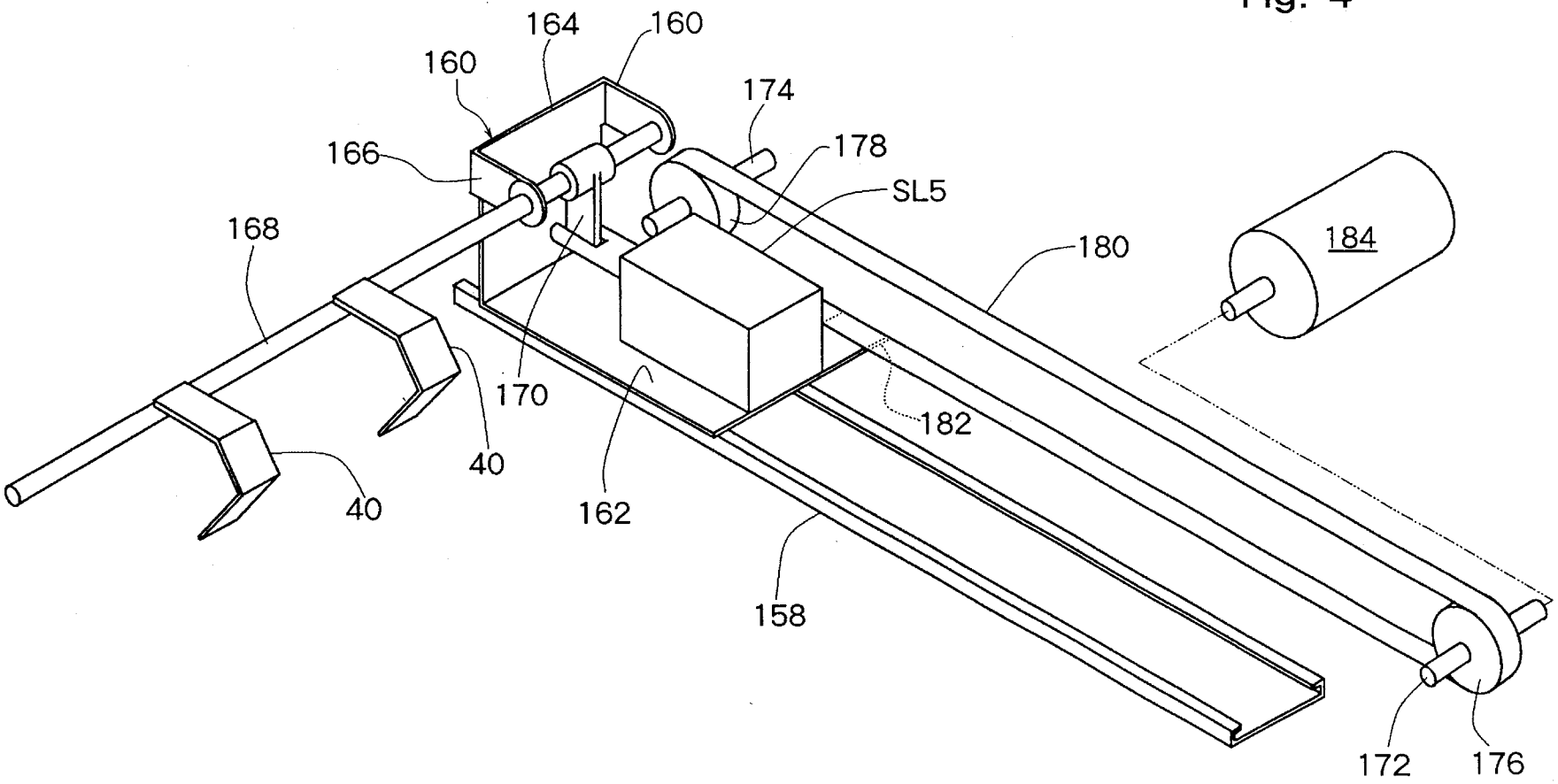
FIG. 4 is a partial perspective view illustrating a front-end-of-document restriction member and a constitution related thereto in the document conveying apparatus shown in FIG. 1.

Constitution of the second document transfer mechanism 110 is substantially the same as that of the above-mentioned first document transfer mechanism 108, and includes a driven shaft 136 and a follower shaft 138 that are rotatably mounted at a distance in the document conveying direction as illustrated in FIG. 2. Four pulleys 140 are fitted to the driven shaft 136 at a suitable distance in the axial direction thereof and, similarly, four pulleys 142 are fitted to the follower shaft 138 at a suitable distance in the axial direction thereof. Endless belts 144 are wrapped around pulleys 140 and 142 which are in a relationship of pairs. A protruding member 146 is fitted to the upper running portion of each of the endless belts 144. Each of the protruding members 146 has a base portion (not shown) fitted to the endless belt 144 and a protruding main portion 148 which upwardly protrudes from the base portion. It is desired that the upper surface 150 on the upstream side (upper surface on the left side in FIG. 2) of the protruding main portion 148 of the protruding member 146 be upwardly tilted at a relatively moderate angle which may be, for example, about 45 degrees toward the downstream side. It is desired that a steep surface 152 which is substantially vertical be formed on the downstream side (left side in FIG. 2) of the protruding main portion 148 of the protruding member 146. The driven shaft 136 is drivably coupled to a rotary drive source 154 which may be an electric motor via a suitable transmission means (not shown), and are is suitably rotated in either the normal direction or the reverse direction to drive the endless belt 144. The protruding member 146 is allowed to be reciprocatingly moved between a retracted position indicated by a solid line in FIG. 2 and a most advanced position indicated by a two-dotted chain line in FIG. 2. As will be understood with reference to FIGS. 1 and 2, four slits 156 are formed in the turn plate 106, which slits extend in the direction of conveyance and spaced from each other in the direction of width (direction perpendicular to the surface of the paper in FIG. 2). At the retracted position, the protruding member 146 is located on the upstream side of the second document discharge port. When the protruding member 146 advances from the retracted position toward the downstream direction, the turn plate 106 is located at the descended position indicated by a two-dotted chain line, the protruding main portion 148 of the protruding member 146 upwardly protrudes through the slit 156 formed in the turn plate 106 and is advanced in this condition. The protruding main portion 148 of the protruding member 146 acts upon the rear edge of the documents which are stacked, being delivered from the second document discharge port 100, and of which the rear edges are positioned on the turn plate 106, and thus the stack of documents is advanced toward the downstream direction. As will be described later, on the other hand, when the documents which are relatively short in the direction of conveyance are placed on the document-placing plate means 18 in a stacked state and a document at the lowermost position of the stack is discharged onto the document-placing plate means 18, being delivered from the document conveying passage 56 through the document delivery passage 74, the protruding main portion 148 of the protruding member 146 is brought in contact with the rear end, or is positioned close to the rear end, of the documents that are placed in a stacked state, and the discharged document goes over the protruding main portion 148 of the protruding member 146 and is advanced to the upper portion of the stack of documents. The thickness of the stack of documents placed on the document-placing plate means 18 is limited to be smaller than the height of the protruding main portion 148 of the protruding member 146, i.e., limited to be smaller than the height of the protrusion which protrudes beyond the surface of the turn plate 106. Therefore, the document that is discharged through the second document discharge port 100 is advanced over the protruding main portion 148 of the protruding member 146, and is placed at the uppermost position of the stack of documents on the document-placing plate means, thus being reliably prevented from being mixed into the stack of documents. Front-end-of-document restriction members:

With reference to FIG. 4 as well as FIG. 2, within the above-mentioned rear-side cover 16 (FIG. 1) is disposed a guide rail mechanism 158 (a guide rail mechanism that is available in the market in the trade name of "Accuride" is preferably used) which extends substantially horizontally. A bracket 160 is slidably mounted on the guide rail mechanism 158. The bracket 160 has a horizontal portion 162 which extends substantially horizontally, an upright portion 164 which upwardly extends from the front end of the horizontal portion 162, and a pair of support arms 166 which rearwardly protrude from both sides at upper ends of the upright portion 164. A support shaft 168 is rotatably mounted on the support arms 166 extending substantially horizontally in the direction of width. The support shaft 168 extends above the stationary plate 20 beyond the rear-side cover 16, and the pair of front-end-of-document restriction members 40 are fitted to the extended portion of the support shaft 168. A lever 170 which downwardly extends is fitted to the rear end of the support shaft 168. An electromagnetic solenoid SL5 is mounted on the horizontal portion 162 of the bracket 160, and the output rod of the electromagnetic solenoid SL5 is pivotably coupled to the lever 170. When the electromagnetic solenoid SL5 is de-energized, the front-end-of-document restriction members 40 are located at the descended position by being resiliently urged in the clockwise direction in FIG. 2 by a resilient member (not shown) that is provided for the electromagnetic solenoid SL5, and the lower ends thereof are brought into resilient contact with the surface of the stationary plate 20 or with the surface of the document placed thereon. When the electromagnetic solenoid SL5 is energized, the front-end-of-document restriction members 40 are turned in the counterclockwise direction in FIG. 2, and are brought to the ascended position indicated by the two-dotted chain line in FIG. 2, and their lower ends are upwardly separated away from the surface of the stationary plate 20 or the surface of the document placed thereon. A driven shaft 172 and a follower shaft 174 are rotatably mounted at a distance in the document conveying direction (in the right-and-left direction in FIG. 2) at the back of the guide rail mechanism 158. Pulleys 176 and 178 are fitted to the driven shaft 172 and the follower shaft 174, respectively, and an endless belt 180 is wrapped around the pulleys 176 and 178. A protruding portion 182, which rearwardly protrudes, is formed on the horizontal portion 162 of the bracket 160 and is coupled to the lower running portion of the endless belt 180. The driven shaft 172 is coupled to a rotary drive source 184, which may be an electric motor, via a suitable transmission means (not shown). By rotating the rotary drive source 184 in the normal and reverse directions, the front-end-of-document restriction members 40 are moved in the document conveying direction between the advanced position indicated by a solid line in FIG. 2 and the most retracted position indicated by a two-dotted chain line in FIG. 2.

Figure 5:
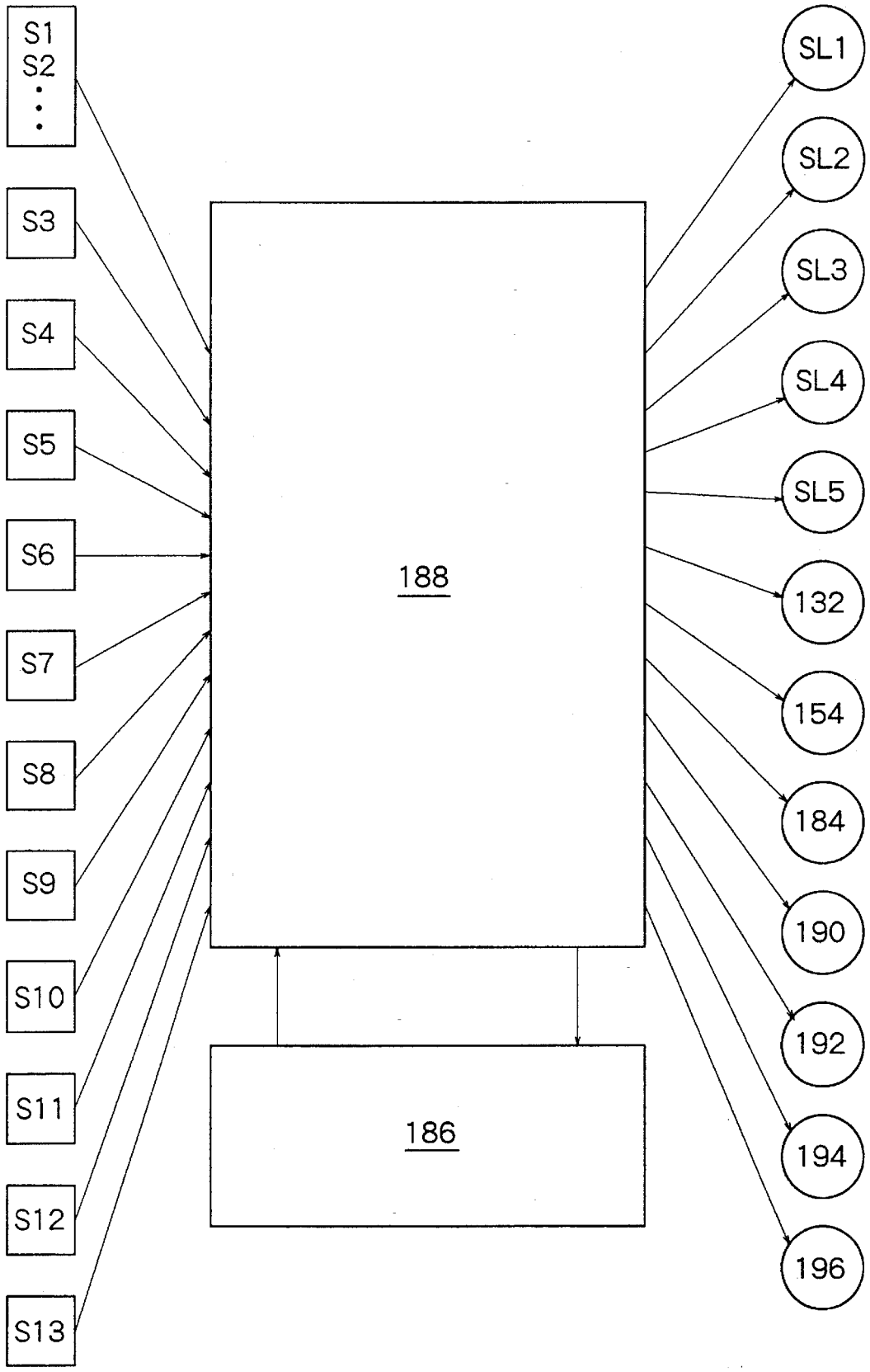
FIG. 5 is a diagram which schematically illustrates a control-related constitution disposed in the document conveying apparatus shown in FIG. 1.
Figure 6:
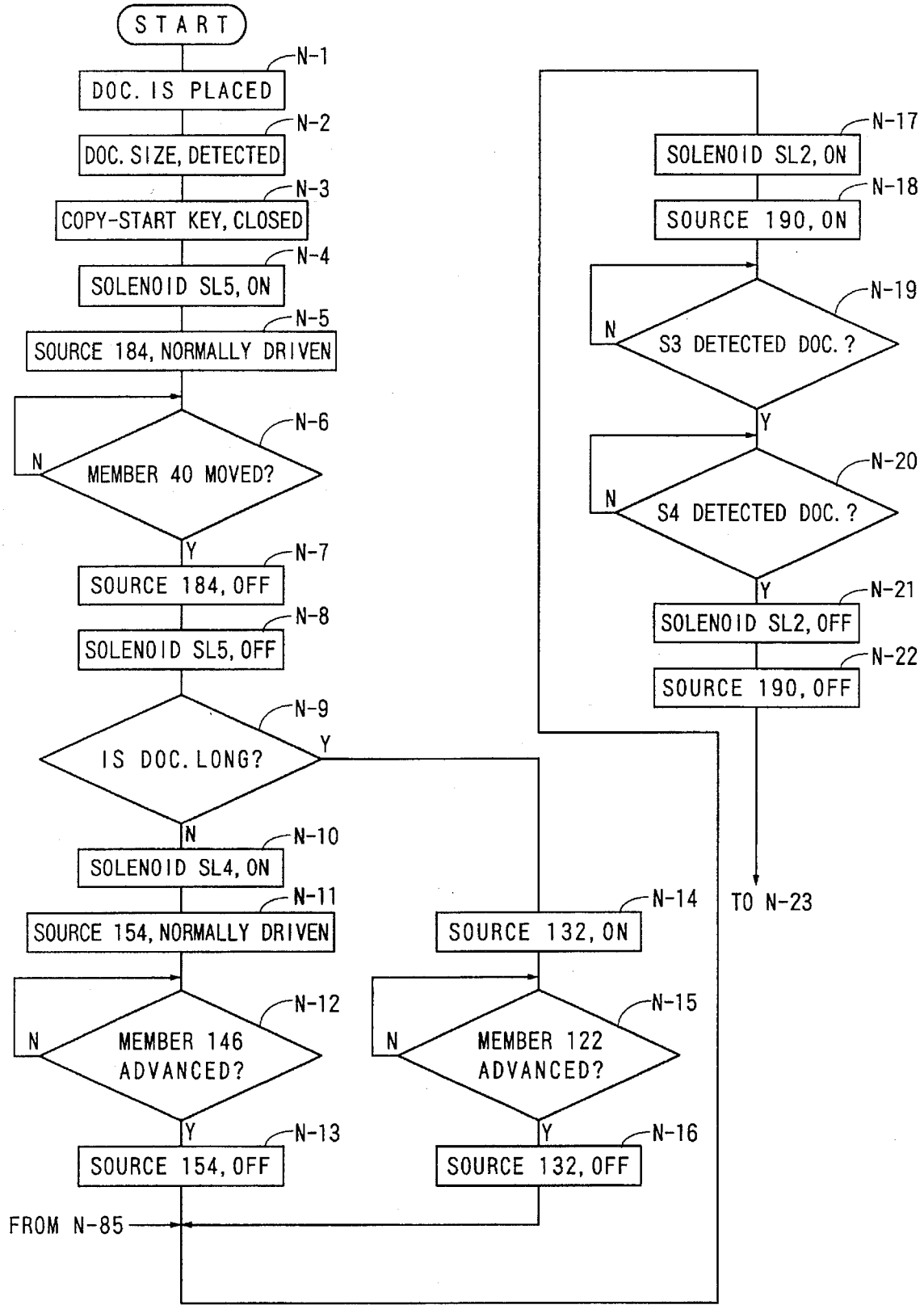
FIG. 6 is a flow chart illustrating part of the procedure for operating the document conveying apparatus of FIG. 1.
Figure 7:
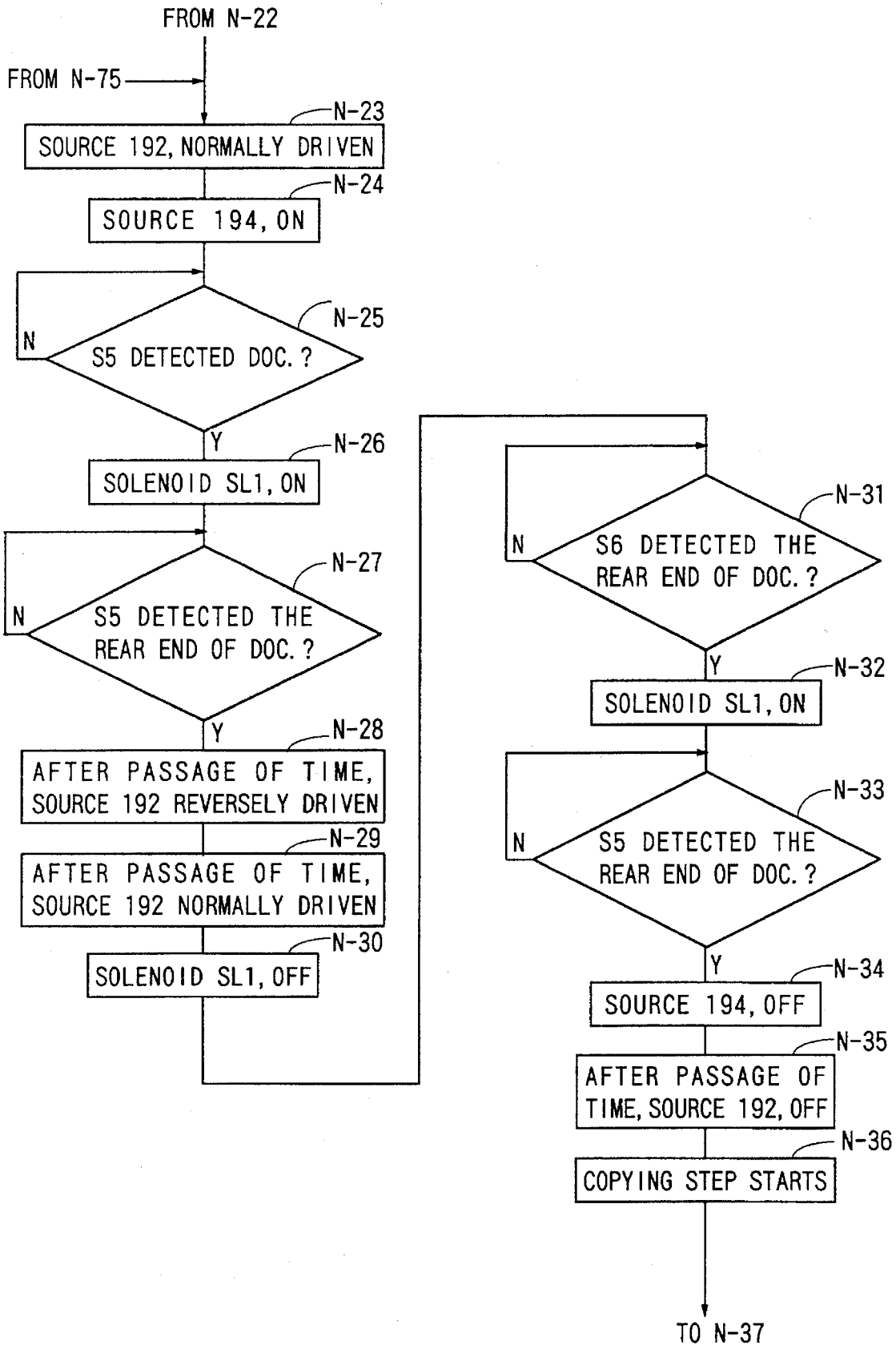
FIG. 7 is a flow chart illustrating part of the procedure for operating the document conveying apparatus of FIG. 1.
Figure 8:
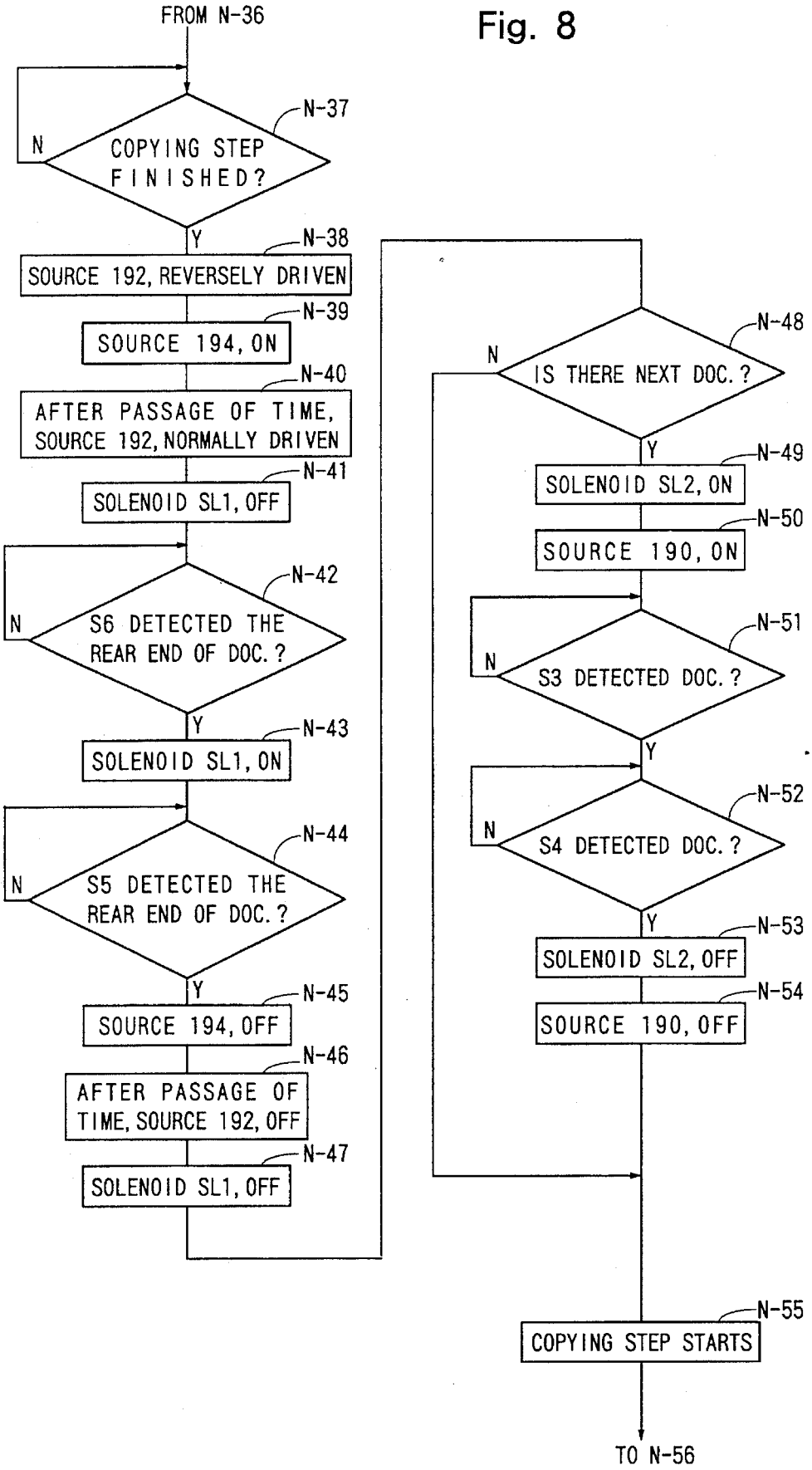
FIG. 8 is a flow chart illustrating part of the procedure for operating the document conveying apparatus of FIG. 1.
Figure 9:
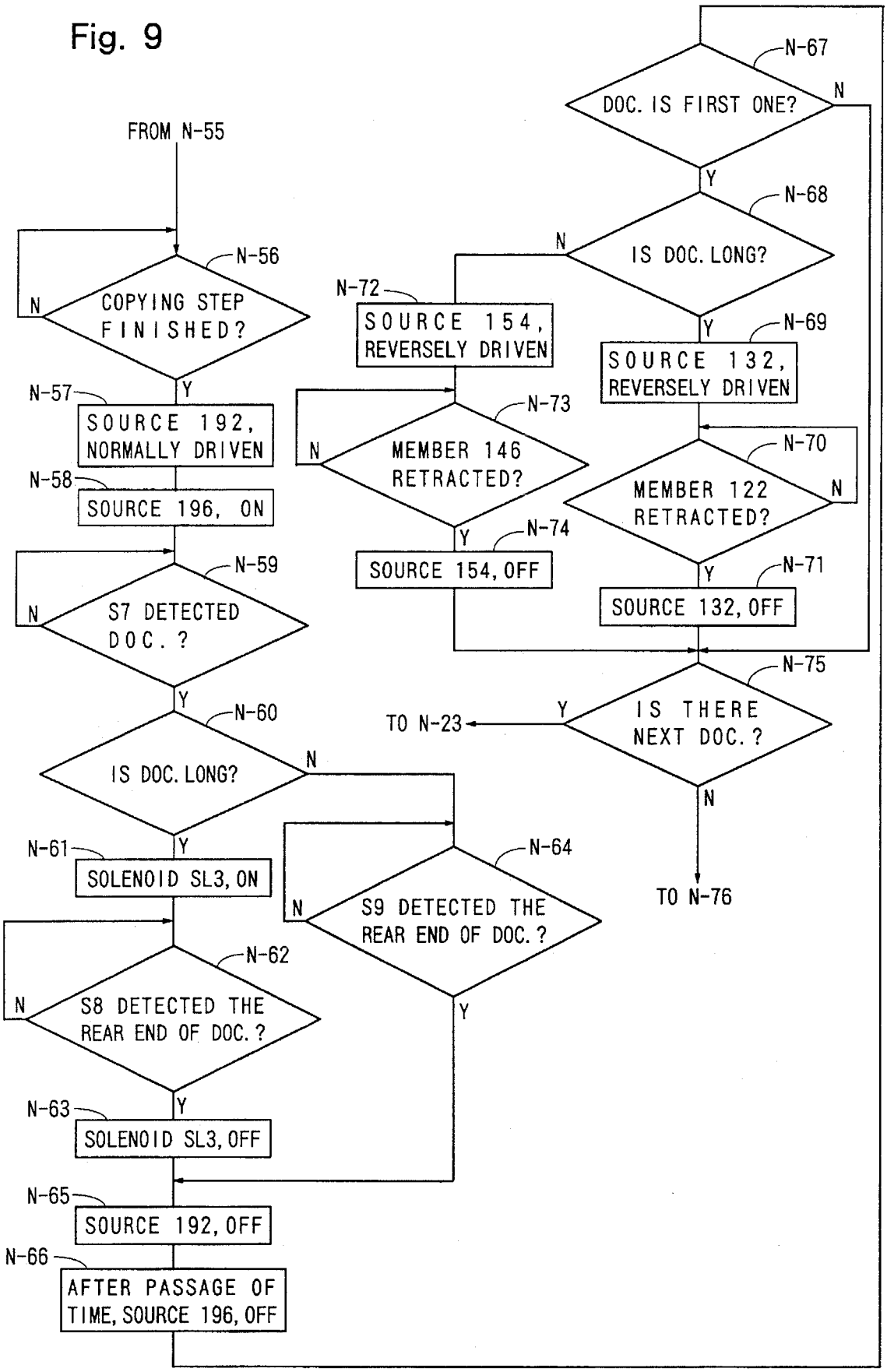
FIG. 9 is a flow chart illustrating part of the procedure for operating the document conveying apparatus of FIG. 1.
Figure 10:
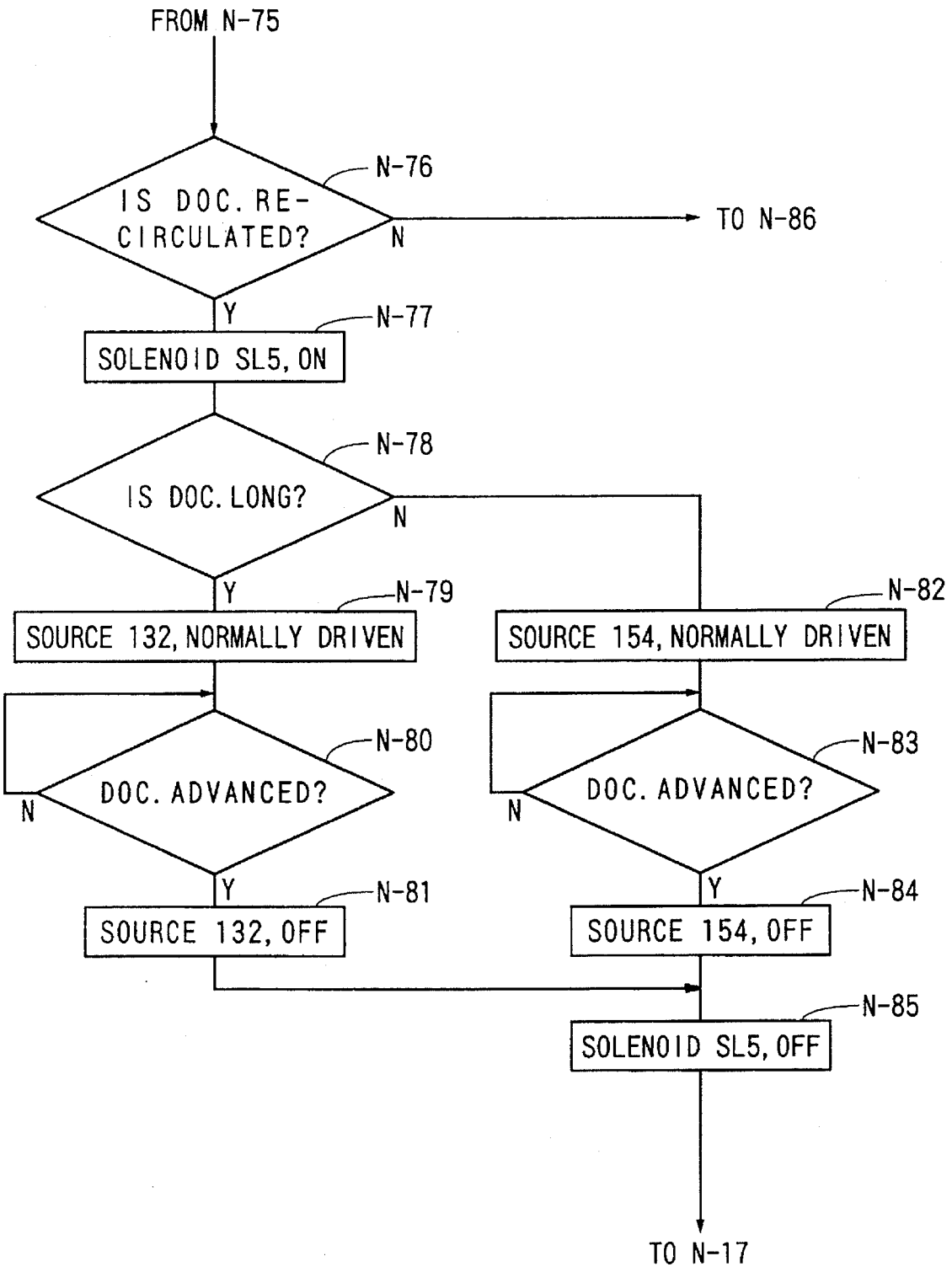
FIG. 10 is a flow chart illustrating part of the procedure for operating the document conveying apparatus of FIG. 1.
Figure 11:
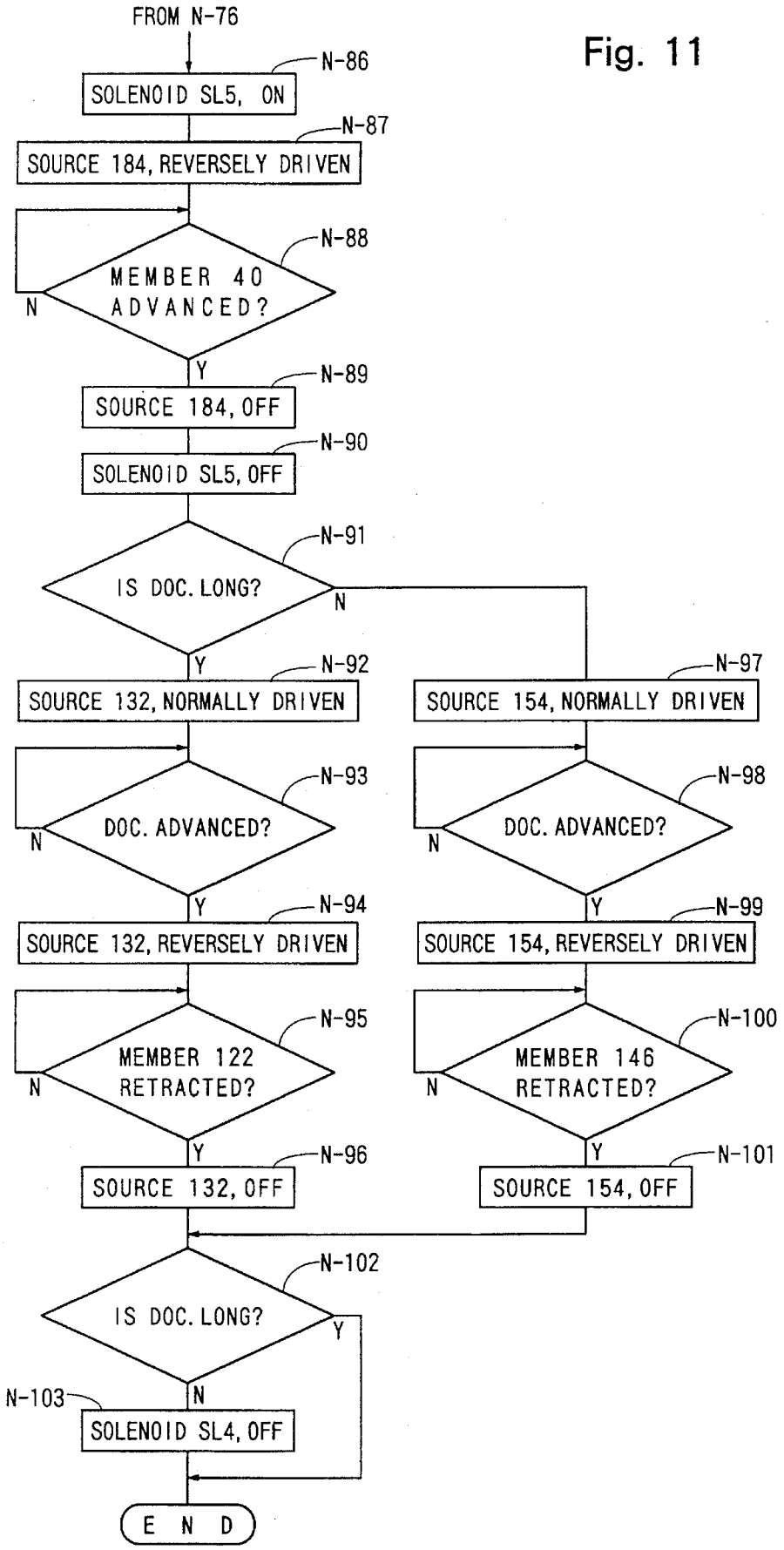
FIG. 11 is a flow chart illustrating part of the procedure for operating the document conveying apparatus of FIG. 1.

Procedures of operation:

Procedures of operation of the above-mentioned document conveying apparatus 4 will now be described with reference to FIGS. 2 and 5, as well as the flow charts of FIGS. 6 through 11 (In FIGS. 6 through 11, "doc." stands for "document".)

FIGS. 6 to 11 illustrate the procedures of operation of when a plurality of documents placed, being stacked, on the document-placing plate means 18 are set to be put to the both surfaces-copying operation (such a setting is set by manipulating a suitable key of the operation panel disposed on the upper surface of the housing 6 of the electrostatic copying machine 2, and a signal indicating the above setting condition is sent to a control means 188 in the document conveying apparatus 4 from a control means 186 in the electrostatic copying machine 2). At a step N-1, a plurality of documents are placed, being stacked, on the document-placing plate means 18 and are detected by a detector S13 which may be a reflection-type optical detector. At this moment, the front end of the stack of documents is brought in contact with the front-end-of-document restriction members 40 that are located at the advanced position indicated by a solid line in FIG. 2. Thus, the front end of the document is brought to the required position. A step N-2 detects the size of the document placed on the document-placing plate means 18. The size of the document is detected in a manner described below. That is, positions in the direction of width of the pair of width restriction members 34 that are moved by hand to a predetermined position in accordance with the size of the document in the direction of width, are detected by a plurality of detector means (not shown), and the presence of the document is detected by a document detector S1 exposed on the surface of the turn plate 106 and by a document detector S2 exposed on the surface of the stationary plate 104, whereby the length in the direction of conveyance of the document is detected. The document detectors S1 and S2 can be constituted by using reflection-type optical detectors. At a step N-3 a copy-start key that is disposed on the operation panel of the electrostatic copying machine 2 is closed. At a step N-4, the electromagnetic solenoid SL5 mounted on the front-end-of-document restriction members 40 is energized, whereby the front-end-of-document restriction members 40 are brought to the ascended position indicated by a two-dotted chain line in FIG. 2 to permit the introduction of the document. At a step N-5, the rotary drive source 184 is rotated in the normal direction to move the front-end-of-document restriction members 40 in the direction of conveying document, whereby the front-end-of-document restriction members 40 start moving toward the upstream side. Then, a step N-6 discriminates whether the front-end-of-document restriction members 40 have been moved toward the upstream side up to a predetermined position that corresponds to the length of the placed document in the direction of conveyance. When the front-end-of-document restriction members 40 have been moved to the predetermined position, the program proceeds to a step N-7 where the rotary drive source 184 is stopped. Then, a step N-8 de-energizes the electromagnetic solenoid SL5, whereby the front-end-of-document restriction members 40 are lowered to the descended position, and the lower ends of the front-end-of-document restriction members 40 are brought into resilient contact with the surface of a document at the uppermost position of the stack of documents placed on the document-placing plate means 18. A step N-9 discriminates whether the document placed on the document-placing plate means 18 has a length which is relatively long in the direction of conveyance or not. For instance, documents discriminated to be relatively short in the direction of conveyance are those of JIS Standards B5, A5 size that is transversely arranged, A5, A4, A4 that is transversely arranged, and those having sizes of 8.5×11 inches, 5.5×8.5 inches, 8.5×11 inches that is transversely arranged. Such sizes are used the United States and European countries. On the other hand, documents discriminated to be relatively long in the direction of conveyance are those of JIS Standards B4, A3, and those of Folio, CF, 8.5×14 inches, 11×17 inches, which are regular sizes used in the United States and European countries. The words "transversely arranged" mean that the document is turned by 90 degrees with respect to the ordinary arrangement, such that the lengthwise direction of the doment extends in the direction of width on the document-placing plate means 18. When the document is relatively short in the direction of conveyance, the program proceeds to a step N-10 where the electromagnetic solenoid SL4, mounted on the turn plate 106, is energized so that the turn plate 106 is lowered to the descended position indicated by a two-dotted chain line in FIG. 2. Then, at a step N-11, a rotary drive source 154 of the second document transfer mechanism 110 is rotated in the normal direction, and a protruding member 146 of the second document transfer mechanism 110 moves forward from a retracted position indicated by a solid line in FIG. 2. A step N-12 discriminates whether a protruding member 146 of the second document transfer mechanism 110 has been advanced to a predetermined position, i.e., whether a protruding main portion 148 of a protruding member 146 has been advanced to a position which is in contact with, or is close to, the rear end of the document placed on the document-placing plate means 18. Then, when the protruding member 146 has been advanced to the predetermined position, the rotary drive source 154 is stopped at a step N-13. When it is discriminated at the step N-9 that the document is relatively long in the direction of conveyance, the program proceeds to a step N-14 where the rotary drive source 132 of the first document transfer mechanism 108 is rotated in the normal direction, and the protruding member 122 of the first document transfer mechanism 108 is moved forward from the retracted position indicated by a solid line in FIG. 2. A step N-15 discriminates whether a protruding member 122 of the first document transfer mechanism 108 is advanced to a predetermined position, i.e., whether a protruding main portion 126 of the protruding member 122 is advanced to a position which is in contact with, or is close to, the rear end of the document placed on the document-placing plate means 18. Then, when the protruding member 122 has been advanced to the predetermined position, the rotary drive source 132 is stopped at a step N-16. Thus, the procedure for setting the initial condition is finished, and the program proceeds to a step N-17.

At the step N-17, the electromagnetic solenoid SL2 mounted on the pushing member 38 is energized, whereby the pushing member 38 is lowered to push the document on the document-placing plate means 18 onto the feed rollers 36. At a step N-18, an introduction drive source 190 (FIG. 5), which may be an electric motor, is energized to operate the document separation means 42 and the feed rollers 36. Thus, among the documents stacked on the document-placing plate means 18, the document at the lowermost position begins to be introduced into the document introduction passage 58. Then, a step N-19 discriminates whether a detector S3 has detected the document on the upstream side of the pair of introduction rollers 66. The detector S3 can be constituted by using a reflection-type optical detector. As the detector S3 detects the document, the program proceeds to a step N-20. The front end of the document that is introduced comes in contact with nip portions of the pair of introduction rollers 66 that are in the inoperative condition. Then, as the front part of the document is bent, it is discriminated whether a detector S4 has detected the document or not. The detector S4 can be constituted by a transmission-type optical detector. As the detector S4 detects the document, the program proceeds to a step N-21 where the electromagnetic solenoid SL2 is de-energized and the pushing member 38 is turned to the ascended position indicated by a solid line in FIG. 2. Then, the introduction drive source 190 is de-energized at a step N-22, whereby the feed rollers 36 and the document separation means 42 are returned back to the inoperative condition.

At a step N-23, a conveyance drive source 192 (FIG. 5), which may be an electric motor, is rotated in the normal direction, and the conveyer belt mechanism 48 starts rotating in the counterclockwise direction in FIG. 2. At a step N-24, an introduction and inversion drive source 194 (FIG. 5), which may be an electric motor is energized, whereby the pair of introduction rollers 66 are rotated, and the inversion roller 62 is rotated, too. Thus, the document that has been introduced up to the pair of introduction rollers 66 is further advanced and is introduced into the document conveying passage 56. A step N-25 discriminates whether a detector S5 has detected the document or not on the downstream side of the pair of introduction rollers 66. As the detector S5 which may be a reflection-type optical detector detects the document, the program proceeds to a step N-26 where the electromagnetic solenoid SL1 mounted on the document restriction member 10 is energized, whereby the document restriction member 10 is lowered to the descended position indicated by a two-dotted chain line in FIG. 2. Then, a step N-27 discriminates whether the rear end of the document has passed over the detector S5 and the detector S5 detects the document no longer. When the detector S5 detects the document no longer, the program proceeds to a step N-28 where the conveyance drive source 192 is changed over to the inversion drive after a passage of a predetermined period of time (a time which the rear end of the document requires to pass over the document restriction member 10), and the conveyer belt mechanism 48 starts rotating in the clockwise direction in FIG. 2. Thus, the document that is once introduced into the document conveying passage 56 is returned back from the document conveying passage 56 and is introduced into the document inverting passage 60. At a step N-29, the conveyance drive source 192 is changed over again to the normal drive after the passage of a period of time which corresponds to the length in the direction of conveyance of the document introduced into the document conveying passage 56 (or more specifically, after the passage of a time required by the rear end of the document once introduced into the document conveying passage 56 to pass over the tip of the document restriction member 10 in the reverse direction). At a step N-30, the electromagnetic solenoid SL1 is de-energized and the document restriction member 10 is returned back to the acting position. A step N-31 discriminates whether a detector S6 has detected the rear end of the document that is transferred through the document inverting passage 60, i.e., discriminates whether the document that was once detected is no longer detected. The detector S6 can be constituted by using a microswitch. As the detector S6 detects the rear end of the document, the program proceeds to a step N-32 where the electromagnetic solenoid SL1 is energized and the document restriction member 10 is lowered again to the descended position. The program then proceeds to a step N-33 which discriminates whether the detector S5 has detected the rear end of the document that has passed through the document inverting passage 60 and is inverted front side back, i.e., discriminates whether the document that was once detected is no longer detected. As the detector S5 detects the rear end of the document, the program proceeds to a step N-34 where the inversion drive source 194 is de-energized, the pair of introduction rollers 66 are placed in the inoperative condition, and the inverting roller 62 is also placed in the inoperative condition. A step N-35 de-energizes the conveyance drive source 192 after the passage of a predetermined period of time (a time which the rear end of the document requires to pass over the document restriction member 10) and places the conveyer belt mechanism 48 in the inoperative condition. Then, the document of which the front side back is inverted is placed at a predetermined position (with its one edge being positioned in contact with, or close to, the tip of the document restriction member 10) on the transparent plate 8 of the electrostatic copying machine 2. At a step N-36, a copying step start signal is sent to the control means 186 of the electrostatic copying machine 2, so that the step of copying starts.

A step N-37 discriminates whether the step of copying is finished or not (whether the control means 186 of the electrostatic copying machine 2 has produced a document exchange signal). When the step of copying is finished in the electrostatic copying machine 2, the program proceeds to a step N-38 where the conveyance drive source 192 begins to rotate in the reverse direction, and the conveyer belt mechanism 48 starts rotating in the clockwise direction in FIG. 2. At a step N-39, the introduction and inversion drive source 194 is energized to actuate the pair of introduction rollers 66 and the inversion roller 62. Thus, the document on the transparent plate 8 is returned back to the document inverting passage 60 from the document conveying passage 56. At a step N-40 the conveyance drive source 192 is changed over to the normal drive after the passage of a period of time which corresponds to the length in the direction of conveyance of the document that is introduced onto the document conveying passage 56. A step N-41 de-energizes the electromagnetic solenoid SL1, and the document restriction member 10 is returned back to the acting position. A step N-42 discriminates whether the detector S6 has detected the rear end of the document that is transferred through the document inverting passage 60. As the detector S6 detects the rear end of the document, the program proceeds to a step N-43 where the electromagnetic solenoid SL1 is energized and the document restriction member 10 is lowered again to the descended position. The program then proceeds to a step N-44 which discriminates whether the detector S5 has detected the rear end of the document that has passed through the document inverting passage 60 and that is inverted front surface back again. As the detector S5 detects the rear end of the document, the program proceeds to a step N-45 where the introduction and inversion drive source 194 is de-energized, and the pair of introduction rollers 66 and the inverting roller 62 are placed in the inoperative condition. At a step N-46, the conveyance drive source 192 is de-energized after the passage of a predetermined period of time (time which the rear end of the document requires to pass over the document restriction member 10), and the conveyer belt mechanism 48 is placed in the inoperative condition. Thus, the document of which the front surface is inverted back again is placed at a predetermined position on the transparent plate 8 of the electrostatic copying machine 2. The electrostatic copying machine 2 begins the step of copying the document. At a step N-47, the electromagnetic solenoid SL1 is de-energized and the document restriction member 10 is returned back to the acting position. A step N-48 discriminates whether there is a subsequent document that should be introduced onto the document-placing plate means 18. When there is the subsequent document that should be introduced, the program proceeds to a step N-49 where the electromagnetic solenoid SL2 is energized, and the pushing member 38 is lowered to push the document on the document-placing plate means 18 onto the feed rollers 36. A step N-50 energizes the introduction drive source 190 to actuate the feed rollers 36 and the document separation means 42. Thus, the next document, i.e., the document at the lowermost position in the stack of documents on the document-placing plate means 18 begins to be introduced into the document introduction passage 58. Then, a step N-51 discriminates whether the detector S3 has detected the document or not. As the detector S3 detects the document, the program proceeds to a step N-52 where it is discriminated whether the detector S4 has detected the document or not. As the detector S4 detects the document, the program proceeds to a step N-53 where the electromagnetic solenoid SL2 is de-energized and the pushing member 38 is returned back to the ascended position indicated by the solid line in FIG. 2. At a step N-54, the introduction drive source 190 is de-energized, and the feed rollers 36 and the document separation means 42 are returned back to the inoperative condition. The program then proceeds to a step N-55. When the step N-48 has discriminated that there is no subsequent document that should be introduced onto the document-placing plate means 18, the program proceeds directly to the step N-55 where a copying step start signal is sent to the control means 186 of the electrostatic copying machine 2, and the electrostatic copying machine 2 starts the step of copying.

A step N-56 discriminates whether the step of copying has finished or not in the electrostatic copying machine 2. When the step of copying has finished in the electrostatic copying machine 2, the program proceeds to a step N-57 where the conveyance drive source 192 is rotated in the normal direction and the conveyer belt mechanism 48 is rotated in the counterclockwise direction in FIG. 2. At a step N-58, a delivery drive source 196 (FIG. 5) which may be an electric motor is energized and the delivery roller 82 is rotated in the counterclockwise direction in FIG. 2. Thus, the document on the transparent plate 8 is conveyed from the document conveying passage 56 to the document delivery passage 74 and is delivered onto the document-placing plate means 18 through the document delivery passage 74. A step N-59 discriminates whether a detector S7 has detected the document at the upstream end of the document delivery passage 74. The detector S7 may be constituted by a micro-switch. As the detector S7 detects the document, the program proceeds to a step N-60 where it is discriminated whether the document is relatively long or not in the direction of conveyance. When the document is relatively long in the direction of conveyance, the program proceeds to a step N-61 where the electromagnetic solenoid SL3 mounted on the delivery control plate 94 is energized and the delivery control plate 94 is brought to a long document delivery position indicated by a two-dotted chain line in FIG. 2. Then, a step N-62 discriminates whether a detector S8 has detected the rear end of the document at the downstream end of the first branched delivery passage 78, i.e., whether the document that was once detected is now no longer detected. The detector S8 may be a reflection-type optical detector. As the detector S8 detects the rear end of the document, the program proceeds to a step N-63 where the solenoid SL3 is de-energized and the delivery control plate 94 is returned back to a short-document delivery position indicated by a solid line in FIG. 2. When the document is relatively short in the direction of conveyance at the step N-60, the program proceeds to a step N-64 where it is discriminated whether a detector S9 has detected the rear end of the document at the downstream end of the second branched delivery passage 80, i.e., whether the document that was once detected is now no longer detected.

At a step N-65, the conveyance drive source 192 is de-energized and the conveyer belt mechanism 48 is placed in the inoperative condition. A step N-66 de-energizes the inversion drive source 196 after the passage of a predetermined period of time (time required until the rear end of the document detected by the detector S8 or S9 is delivered onto the document-placing plate means 18 through the first document discharge port 96 or the second document discharge port 100) to stop the delivery roller 82. A step N-67 discriminates whether the delivered document is the first document or not. When the detected document is the first document, the program proceeds to a step N-68 where it is discriminated whether the document is relatively long in the direction of conveyance or not. When the document is relatively long in the direction of conveyance, the program proceeds to a step N-69 where the rotary drive source 132 of the first document transfer mechanism 108 is reversely rotated and the protruding member 122 of the first document transfer mechanism 108 is retracted toward the right in FIG. 2. A step N-70 discriminates whether a detector S10 has detected the protruding member 122 that is at the retracted position indicated by a solid line in FIG. 2. As the detector S10 which may be a transmission-type optical detector detects the protruding member 22 at the retracted position, the program proceeds to a step N-71 where the rotary drive source 132 is de-energized and the protruding member 122 is stopped at the retracted position. When the document is relatively short in the direction of conveyance at the step N-68, the program proceeds to a step N-72 where the rotary drive source 154 of the second document transfer mechanism 110 is reversely rotated and the protruding member 146 of the second document transfer mechanism 110 is retracted toward the right in FIG. 2. A step N-73 discriminates whether a detector S11 has detected the protruding member 146 at the retracted position indicated by a solid line in FIG. 2. As the detector S11 which may be a transmission-type optical detector detects the protruding member 146 at the retracted position, the program proceeds to a step N-74 where the rotary drive source 154 is de-energized and the protruding member 146 is stopped at the retracted position. Thereafter, the program proceeds to a step N-75 where it is discriminated whether there is a document waiting for its turn in the document introduction passage 58. When there is a document waiting for its turn in the document introduction passage 58, the program returns back to the step N-23.

When a document is not waiting for its turn in the document introduction passage 58 at the step N-75, the program proceeds to a step N-76 where it is discriminated whether the document delivered onto the document-placing plate means 18 through the document delivery passage 74 is to be recirculated or not, i.e., whether the document is to be introduced again into the document conveying passage 56 through the document introduction passage 58. When the delivered document is to be recirculated, the program proceeds to a step N-77 where the electromagnetic solenoid SL5 is energized and the front-end-of-document restriction members 40 are brought to the ascended position (up to this moment, the front-end-of-document restriction members 40 are in contact with the document that exists thereunder or is in contact with the surface of the stationary plate 20 at a position that is moved from the advanced position toward the upstream side by a distance which corresponds to the length of the document in the direction of conveyance, and the document delivered from the document delivery passage 74 is restricted to a predetermined position on the document-placing plate means 18 in the lengthwise direction by its front end being in contact with the front-end-of-document restriction members 40). A step N-78 discriminates whether the document is relatively long in the direction of conveyance or not. When the document is relatively long in the direction of conveyance, the program proceeds to a step N-79 where the rotary drive source 132 of the first document transfer mechanism 108 is rotated in the normal direction. Thus, the protruding member 122 of the first document transfer mechanism 108 located at the back of the document delivered onto the document-placing plate means 18 is advanced, whereby the document delivered onto the document-placing plate means 18 is advanced. A step N-80 discriminates whether the document has been advanced to a predetermined position by the first document transfer mechanism 108, i.e., whether the document has been advanced to a position suited for being introduced into the document conveyance passage 56 passing through the document introduction passage 58 by the action of the feed rollers 36 and the other rollers. When the document is advanced to a predetermined position, the program proceeds to a step N-81 where the rotary drive source 132 of the first document transfer mechanism 108 is de-energized. When the document is relatively short in the direction of conveyance at the step N-78, the program proceeds to a step N-82 where the rotary drive source 154 of the second document transfer mechanism 110 is rotated in the normal direction. Thus, the protruding member 146 of the second document transfer mechanism 110 located at the back of the document delivered onto the document-placing plate means 18 is advanced, whereby the document delivered onto the document-placing plate means 18 is advanced. A step N-83 discriminates whether the document has been advanced to a predetermined position by the second document transfer mechanism 110, i.e., whether the document has been advanced to a position suited for being introduced into the document conveyance passage 56 passing through the document introduction passage 58 by the action of the feed rollers 36 and the other. When the document is advanced to a predetermined position, the program proceeds to a step N-84 where the rotary drive source 154 of the second document transfer mechanism 110 is de-energized. At a step N-85, the electromagnetic solenoid SL5 is de-energized and the front-end-of-document restriction members 40 are lowered again to the descended position. Thereafter, the program proceeds to the step N-17 and the introduction of the document is started again.

When the delivered document is not to be recirculated at the step N-76, the program proceeds to a step N-86 where the electromagnetic solenoid SL5 is energized and the front-end-of-document restriction members 40 are brought to the ascended position. At a step N-87, the rotary drive source 184 is rotated in the reverse direction and the front-end-of-document restriction members 40 are advanced toward the downstream side. A step N-88 discriminates whether a detector S12 has detected the front-end-of-document restriction members 40 that are located at the advanced position indicated by a solid line in FIG. 2. As the detector S12, which may be a transmission-type optical detector, detects the front-end-of-document restriction members 40, the program proceeds to a step N-89 where the rotary drive source 184 is de-energized. At a step N-90, the electromagnetic solenoid SL5 is de-energized and the front-end-of-document restriction members 40 are lowered to the descended position. A step N-91 discriminates whether the document is relatively long in the conveyance direction or not. When the document is relatively long in the direction of conveyance, the program proceeds to a step N-92 where the rotary drive source 132 of the first document transfer mechanism 108 is rotated in the normal direction. Thus, the protruding member 122 of the first document transfer mechanism 108 located at the back of the document delivered onto the document-placing plate means 18 is advanced, whereby the document delivered onto the document-placing plate means 18 is advanced. A step N-93 discriminates whether the document has been advanced to the predetermined position by the first document transfer mechanism 108 or not. When the document has been advanced to the predetermined position, the program proceeds to a step N-94 where the rotary drive source 132 of the first document transfer mechanism 108 is rotated in the reverse direction and the protruding member 122 of the first document transfer mechanism 108 is retracted toward the upstream direction. A step N-95 discriminates whether a detector S10 has detected the protruding member 122 that is moved back to the retracted position shown in FIG. 2. As the detector S10 detects the protruding member 122, the program proceeds to a step N-96 where the rotary drive source 132 is de-energized. When the document is relatively short in the direction of conveyance at the step N-91, the program proceeds to a step N-97 and the rotary drive source 154 of the second document transfer mechanism 110 is rotated in the normal direction. Thus, the protruding member 146 of the second document transfer mechanism 110, located at the back of the document delivered onto the document-placing plate means 18, is advanced, whereby the document delivered onto the document-placing plate means 18 is advanced. A step N-98 discriminates whether the document has been advanced to the predetermined position by the second document transfer mechanism 110 or not. As the document has been advanced to the predetermined position, the program proceeds to a step N-99 where the rotary drive source 154 of the second document transfer mechanism 110 is rotated in the reverse direction, and the protruding member 146 of the second document transfer mechanism 110 is retracted toward the upstream direction. A step N-100 discriminates whether a detector S11 has detected the protruding member 146 that is moved back to the retracted position shown in FIG. 2. As the detector S11 detects the protruding member 146, the program proceeds to a step N-101 and the rotary drive source 154 is de-energized. A step N-102 discriminates whether the document is relatively long in the direction of conveyance or not. When the document is relatively short in the direction of conveyance, the program proceeds to a step N-103 where the electromagnetic solenoid SL4 is de-energized and the turn plate 106 is returned back to the ascended position indicated by the solid line in FIG. 2.

When the plurality of documents placed, being stacked, on the document-placing plate means 18 are to be copied on one surface (surface that is upwardly facing on the document-placing plate means 18) only, the steps N-28 to N-43 are omitted in the flow chart shown in FIGS. 6 to 11, and the program directly proceeds from the step N-27 to the step N-44. In other respects, the procedure of operation is the same as that of copying both surfaces of documents.

The document conveying apparatus of the present invention liberates the user from the need of executing cumbersome operation, does not require complex and expensive constitution, enables documents of a variety of sizes being delivered from the document delivery passage onto the document-placing plate means to be placed at the uppermost position of the stack of documents on the document-placing plate means without permitting them to be mixed into the stack of documents, and can reliably advance the document delivered onto the document-placing plate means up to a predetermined position on the document-placing plate means for being introduced again when it is required to introduce the document again onto the document conveying passage through the document introduction passage. The document conveying apparatus is skillfully avoided from becoming high even when the first document discharge port for discharging documents that are relatively long in the direction of conveyance is disposed above the second document discharge port for discharging documents that are relatively short in the direction of conveyance.

Though the document conveying apparatus constituted according to the present invention was described above in detail by way of a preferred embodiment in conjunction with the accompanying drawings, it should be noted that the invention is in no way limited to the above-mentioned embodiment only but can be varied or modified in a variety of other ways without departing from the scope of the invention.

What we claim is:

1. A document conveying apparatus for an image processing machine having a transparent plate for placement thereon of a document to be processed, said document conveying apparatus comprising:

document-placing plate means adapted to be located above the transparent plate of the document processing machine when said document conveying apparatus is mounted on the image processing machine;

means defining a document conveying passage extending along the surface of the transparent plate when said document conveying apparatus is mounted on the image processing machine;

means defining a document introduction passage disposed between said document-placing plate means and said document conveying passage;

means defining a document delivery passage disposed between said document conveying passage and said document-placing plate means;

document introduction means for successively introducing documents one at a time from a stack of documents on said document-placing plate means, through said document introduction passage and into said document conveying passage, starting from the document at the lowermost position of the stack;

document conveying means for conveying the document through said document conveying passage;

document delivery means for delivering the document from said document conveying passage through said document delivery passage and onto said document-placing plate means;

means defining a first document discharge port disposed on the upstream side of said document-placing plate means;

means defining a second document discharge port disposed on the downstream side of said first document discharge port;

means defining a first branched delivery passage leading from said document delivery passage to said first document discharge port;

means defining a second branched delivery passage leading from said document delivery passage to said second document discharge port;

means for sensing the length of the document being conveyed by said document conveying apparatus; and a document delivery control plate responsive to the sensed length of documents for directing documents which are relatively long in the direction of conveyance through said first branched delivery passage and the first document discharge port onto said document-placing plate means and directing documents which are relatively short in the direction of conveyance through said second branched delivery passage and the second document discharge port onto said document-placing plate means;

a first document transfer mechanism for transferring the document discharged from said first document discharge port onto said document-placing plate means toward the downstream direction on the surface of said document-placing plate means; and a second document transfer mechanism for transferring the document discharged from said second document discharge port onto said document-placing plate means toward the downstream direction on the surface of said document-placing plate means.

2. A document conveying apparatus according to claim 1, wherein said first document discharge port is disposed above the surface of said document-placing plate means and said second document discharge port is disposed above the surface of said document-placing plate means but below said first document discharge port.

3. A document conveying apparatus according to claim 2, wherein the surface of said document-placing plate means tilts upward in the downstream direction for a predetermined length from said second document discharge port.

4. A document conveying apparatus according to claim 2, wherein over a predetermined length in the downstream direction from said second document discharge port, said document-placing plate means is defined by a turn plate that is pivotably mounted to pivot on the downstream end thereof; and wherein said apparatus further comprises means responsive to the sensed length of documents for controlling pivoting of said turn plate such that when a document which is relatively long in the direction of conveyance is delivered onto said document-placing plate means through the first branched delivery passage and the first document discharge port, the turn plate is located at an ascended position where its upstream end is located above the second document discharge port and, when a document which is relatively short in the direction of conveyance is delivered onto said document-placing plate means through the second branched delivery passage and the second document discharge port, the turn plate is located at a descended position where its upstream end is located below the second document discharge port.

5. A document conveying apparatus according to claim 4, wherein when located at said ascended position, said turn plate is tilted downward in the downstream direction and when located at said descended position, said turn plate is tilted upward in the downstream direction.

6. A document conveying apparatus according to claim 1, further comprising at least one front-end-of-document restriction member adapted to be freely moved between a descended position in contact with the surface of said document-placing plate means or the surface of a document placed thereon and an ascended position upwardly spaced from the surface of said document-placing plate means, and further to be freely moved along the surface of said document-placing plate means.

7. A document conveying apparatus according to claim 6, further comprising an electromagnetic solenoid for resiliently urging said front-end-of-document restriction member toward the descended position when the electromagnetic solenoid is de-energized and for bringing said front-end-of-document restriction member to the ascended position when the electromagnetic solenoid is energized.

8. A document conveying apparatus according to claim 1, wherein said first document transfer mechanism includes a first protruding member that upwardly protrudes above the surface of said document-placing plate means, and means for reciprocatingly moving said first protruding member between a first retracted position located upstream of said first document discharge port and a first advanced position located a predetermined distance downstream from said first retracted position, and said second document transfer mechanism includes a second protruding member that upwardly protrudes above the surface of said document-placing plate means and means for reciprocatingly moving said second protruding member between a second retracted position located upstream of said second document discharge port and a second advanced position located a predetermined distance downstream from said second retracted position.

9. A document conveying apparatus according to claim 8, where each of said first and second protruding members has an upwardly tilted upper surface extending in the downstream direction.

10. A document conveying apparatus for an image processing machine having a transparent plate for placement thereon of a document to be processed, said document conveying apparatus comprising:

document-placing plate means adapted to be located above the transparent plate of the document processing machine when said document conveying apparatus is mounted on the image processing machine;

means defining a document conveying passage extending along the surface of the transparent plate when said document conveying apparatus is mounted on the image processing machine;

means defining a document introduction passage disposed between said document-placing plate means and said document conveying passage;

means defining a document delivery passage disposed between said document conveying passage and said document-placing plate means, said document delivery passage having a document discharge port disposed at the downstream end of said document delivery passage;

document introduction means for successively introducing documents one at a time from a stack of documents on said document-placing plate means, through said document introduction passage and into said document conveying passage, starting from the document at the lowermost position of the stack;

document conveying means for conveying the document through said document conveying passage;

document delivery means for delivering the document from said document conveying passage through said document delivery passage and onto said document-placing plate means;

a document transfer mechanism including a protruding member that upwardly protrudes above the surface of said document-placing plate means, and means for reciprocatingly moving said protruding member between a retracted position located upstream of said document discharge port and an advanced position located a predetermined distance downstream from said retracted position, said moving means in the quiescent condition thereof positioning said protruding member at the retracted position; and control means for activating said moving means to move said protruding member toward said advanced position to bring said protruding member in contact with, or close to, the rear end of the stack of documents on said document-placing plate means before the first document is introduced into said document introduction passage, to move said protruding member to said retracted position after said first document is delivered through said document delivery passage onto said document-placing plate means, and to move said protruding member to said advanced position after the last document is delivered through said document delivery passage onto said document-placing plate means.

11. A document conveying apparatus according to claim 10, wherein said protruding member has an upwardly tilted upper surface extending in the downstream direction.

* * * * *